US011034154B2

(12) United States Patent
Ueno et al.

(10) Patent No.: US 11,034,154 B2
(45) Date of Patent: Jun. 15, 2021

(54) WASTE INK CONVEYING DEVICE AND IMAGE FORMING APPARATUS

(71) Applicant: KYOCERA Document Solutions Inc., Osaka (JP)

(72) Inventors: Daijiro Ueno, Osaka (JP); Masaki Murashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 71 days.

(21) Appl. No.: 16/436,205

(22) Filed: Jun. 10, 2019

(65) Prior Publication Data

US 2019/0375212 A1 Dec. 12, 2019

(30) Foreign Application Priority Data

Jun. 11, 2018 (JP) ..... JP2018-110977
May 14, 2019 (JP) ..... JP2019-091551

(51) Int. Cl.
*B41J 2/17* (2006.01)
*B41J 29/38* (2006.01)
*B41J 29/58* (2006.01)

(52) U.S. Cl.
CPC ..... *B41J 2/1721* (2013.01); *B41J 29/38* (2013.01); *B41J 29/58* (2013.01); *B41J 2002/1728* (2013.01); *B41J 2202/15* (2013.01)

(58) Field of Classification Search
CPC ..... B41J 2/1721; B41J 2/185; B41J 2/1752; B41J 2/17533; B41J 2002/1728; B41J 2002/1856; B41J 2202/15; B41J 29/38; B41J 29/58
See application file for complete search history.

(56) References Cited

U.S. PATENT DOCUMENTS 4,556,894 A * 12/1985 Terasawa ..... B41J 2/16523 347/30
5,621,450 A * 4/1997 Kawai ..... B41J 2/17533 347/108
6,220,314 B1 4/2001 Sato
(Continued)

FOREIGN PATENT DOCUMENTS

JP H11-286125 A 10/1999

OTHER PUBLICATIONS

Extended European Search Report issued by the European Patent Office dated Oct. 10, 2019, which corresponds to EP19178946.0—1019 and is related to U.S. Appl. No. 16/436,205.

*Primary Examiner* — John Zimmermann
(74) *Attorney, Agent, or Firm* — Studebaker & Brackett PC

(57) ABSTRACT

A waste ink conveying device includes a waste ink tank installed in a tank installed part, and a tank cover opening/closing the tank installed part. The tank cover includes a nozzle, a nozzle operation part and a cover locking part. The nozzle flowing a waste ink is inserted in an inflow port in the waste ink tank. The nozzle operation part switches projecting and retracting of the nozzle to insert and retract the nozzle to the inflow port. The cover locking part switches locking and unlocking of closing of the tank cover. If the cover locking part is in a locking state and the nozzle is in a retracting state, the cover locking part can be switched to an unlocking state. If the cover locking part is in the locking state and the nozzle is in a projecting state, the cover locking part cannot be switched to the unlocking state.

16 Claims, 32 Drawing Sheets

(56) References Cited

U.S. PATENT DOCUMENTS

| | | | | |
|---|---|---|---|---|
| 9,227,407 | B1 * | 1/2016 | Harada | B41J 2/165 |
| 2007/0046721 | A1 * | 3/2007 | Miyazawa | B41J 2/16532<br>347/29 |
| 2009/0219337 | A1 | 9/2009 | Harada et al. | |
| 2016/0303854 | A1 * | 10/2016 | Matsuura | B41J 2/16523 |
| 2017/0043586 | A1 * | 2/2017 | Yanagida | B41J 2/17509 |
| 2018/0244063 | A1 * | 8/2018 | Okumura | B41J 2/16517 |

* cited by examiner

WASTE INK CONVEYING DEVICE AND IMAGE FORMING APPARATUS

INCORPORATION BY REFERENCE

This application is based on and claims the benefit of priority from Japanese Patent application No. 2018-110977 filed on Jun. 11, 2018, and Japanese Patent application No. 2019-091551 filed on May 14, 2019, the entire contents of which are incorporated herein by reference.

BACKGROUND

The present disclosure relates to a waste ink conveying device conveying a waste ink and an image forming apparatus including this waste ink conveying device.

Conventionally, an ink-jet type image forming apparatus ejects an ink to a recording medium, such as a sheet, by a recording head to form an image. The image forming apparatus collects a waste ink caused in the recording head to a waste ink tray, and then, conveys and contains the waste ink into a waste ink tank.

For example, a waste ink treating device of an ink-jet printer is configured so that, in a case where a waste ink bottle (a waste ink tank) is pushed into a waste ink bottle case from a rear part side thereof, a rear part of the waste ink bottle is lifted upper than a front part thereof. Moreover, lifting movement of the rear part is utilized for switching a cap provided an upper part at the rear part side of the waste ink bottle from a closing state to an opening state, and a waste ink ejected from an ink ejecting means is ejected from an upper side to a lower side in the waste ink bottle.

In an ink-jet type image forming apparatus containing a waste ink in a waste ink tank, it is feared that the waste ink is scattered and contaminates the surroundings when the waste ink tank is replaced. The above-mentioned waste ink treating device restrains scattering of the waste ink by switching the cap to the closing state when the waste ink tank is removed. However, in such a configuration, when use of the waste ink tank is repeated, it is feared that the cap is broken. If the cap is broken and cannot be switched to the closing state, the waste ink is leaked and contaminates the surroundings when the waste ink tank is taken out. Alternatively, if the cap is broken and cannot be switched to the opening state, the waste ink tank cannot be installed into a regular position. Or, even if the waste ink can be installed into the regular position, it is feared that ejecting of the waste ink to the waste ink tank is prevented by the cap of the closing state and ink clogging occurs to cause a malfunction and waste ink leakage.

SUMMARY

In accordance with the present disclosure, a waste ink conveying device includes a waste ink tank installed in a tank installed part to contain a waste ink, and a tank cover opening/closing the tank installed part. The waste ink tank includes an inflow port in which the waste ink is flowed from a side of the tank cover. The tank cover includes a nozzle, a nozzle operation part and a cover locking part. The nozzle is inserted in the inflow port to flow the waste ink in the waste ink tank. The nozzle operation part switches projecting and retracting of the nozzle in order to insert and retract the nozzle with respect to the inflow port. The cover locking part switches locking and unlocking of a closing state of the tank cover. In a case where the cover locking part is in a locking state and the nozzle is in a retracting state, the cover locking part is made capable of switching to an unlocking state. On the other hand, in a case where the cover locking part is in the locking state and the nozzle is in a projecting state, the cover locking part is made incapable of switching to the unlocking state.

Moreover, in accordance with the present disclosure, a waste ink conveying device includes a waste ink tank installed in a tank installed part to contain a waste ink, and a tank cover opening/closing the tank installed part. The waste ink tank includes an inflow port in which the waste ink is flowed from a side of the tank cover. The tank cover includes a nozzle, a nozzle operation part and a cover locking part. The nozzle is inserted in the inflow port to flow the waste ink in the waste ink tank. The nozzle operation part switches projecting and retracting of the nozzle in order to insert and retract the nozzle with respect to the inflow port. The cover locking part switches locking and unlocking of a closing state of the tank cover. In a case where the cover locking part is in a unlocking state and the nozzle is in a retracting state, the nozzle is made incapable of switching to a projecting state.

In accordance with the present disclosure, an image forming apparatus includes any one of the above-described waste ink conveying device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, entire structure of a printer 1 as an ink-jet type image forming apparatus 1 according to a first embodiment of the present disclosure will be described with reference to FIGS. 1 and 2. Hereinafter, for convenience of description, it will be described so that the front side of the printer 1 is positioned at a near side on a paper sheet of FIG. 1. Arrows Fr, Rr, L, R, U and Lo in each of the drawings respectively indicate a front side, a rear side, a left side, a right side, an upper side and a lower side of the printer 1.

Figure 1:
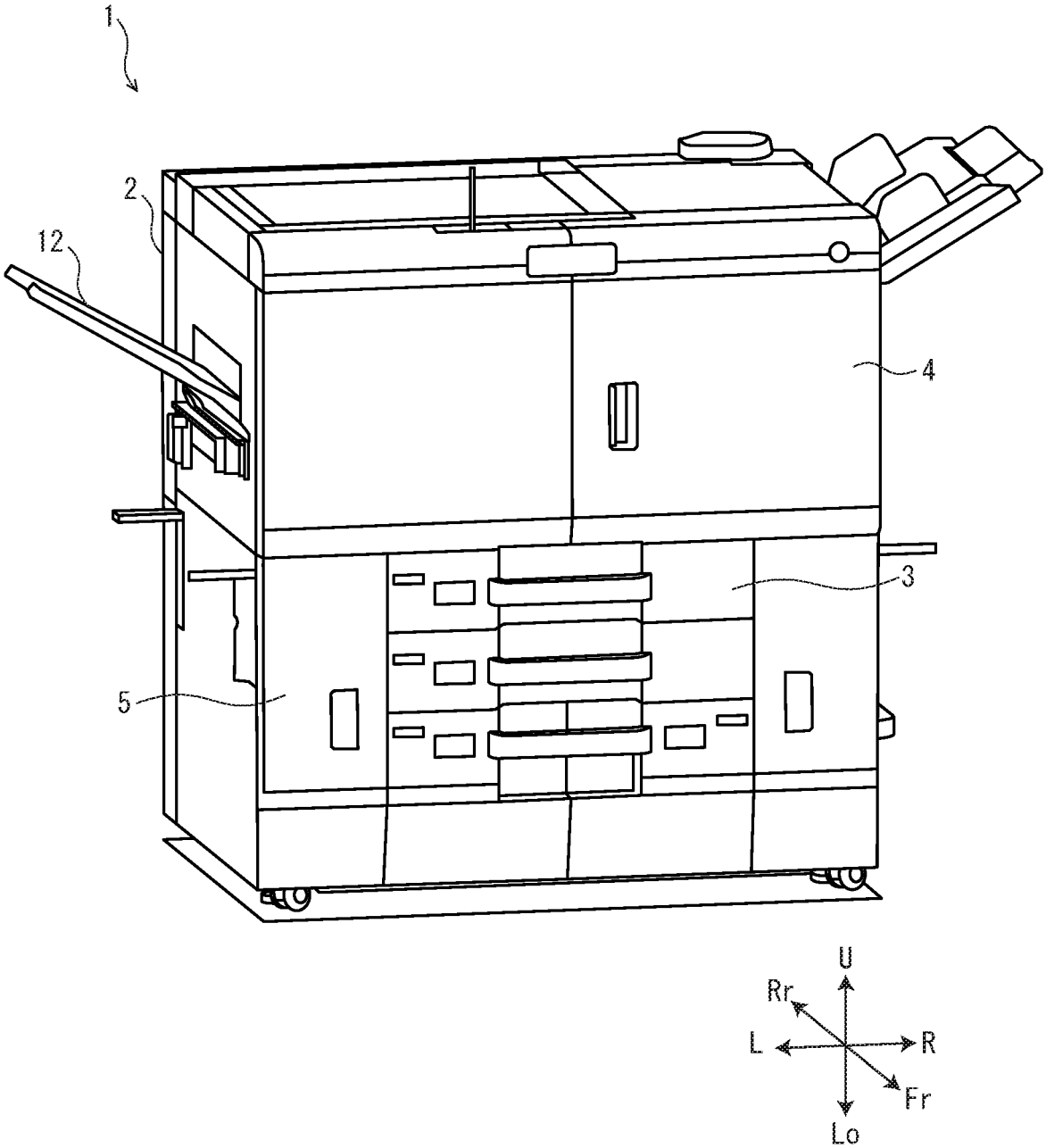
FIG. 1 is a perspective view showing a printer according to a first embodiment of the present disclosure.
Figure 2:
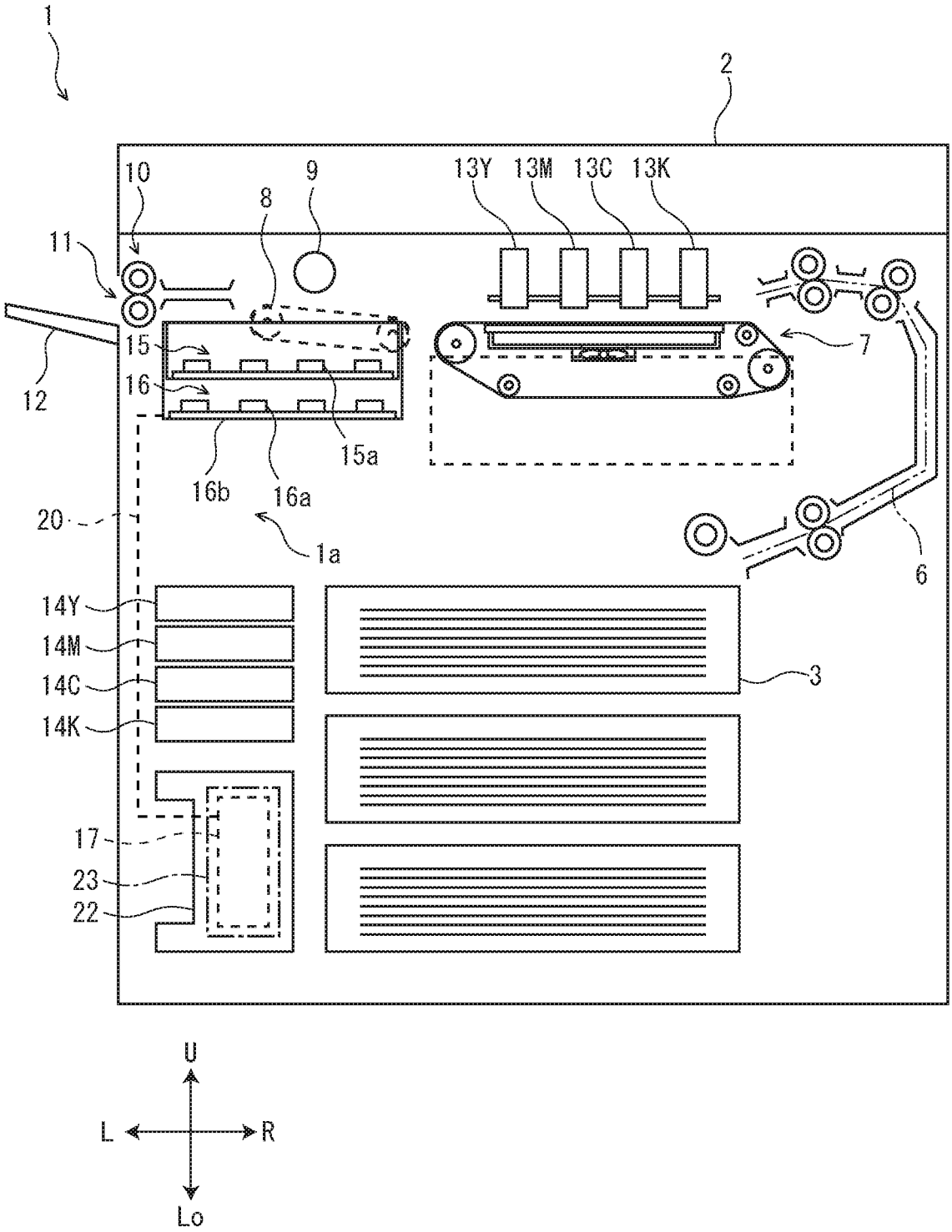
FIG. 2 is a sectional view schematically showing the printer according to the first embodiment of the present disclosure.

As shown in FIGS. 1 and 2, the printer 1 includes a box-shape printer body 2. In a lower part of the printer body 2, a sheet feeding cartridge 3 storing sheets is drawably housed.

Figure 3:
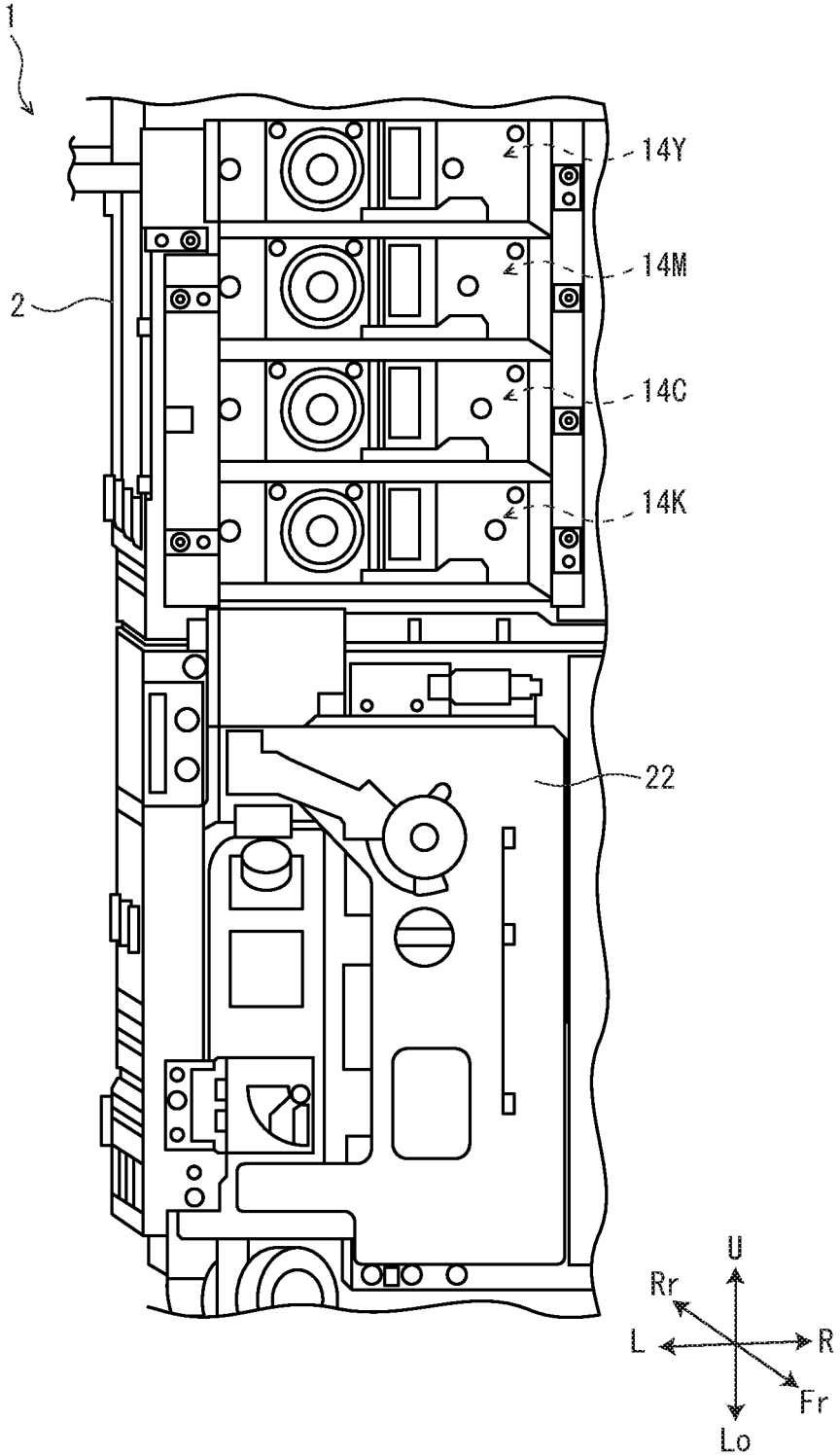
FIG. 3 is a sectional view showing the inside of a left lower part of the printer according to the first embodiment of the present disclosure.

In a front face of the printer body 2, an upper side cover 4 and a left lower side cover 5 are openably/closably provided. When the upper side cover 4 is opened, a sheet conveying unit 7, a cap unit 15 and a wiper unit 16 described below become conditions capable of maintenance. Moreover, as shown in FIG. 3, when the left lower side cover 5 is opened, ink containers 14 and a waste ink tank 17 described below become conditions capable of replacement.

In a right part inside the printer body 2, a conveyance path 6 of the sheet is arranged and, in a center part inside the printer body 2, the sheet conveying unit 7 is ascendably/descendably arranged above the sheet feeding cartridge 3. The conveyance path 6 is provided from the sheet feeding cartridge 3 to the sheet conveying unit 7 and, along a conveying direction of the sheet on the conveyance path 6, a sheet feeding roller, a conveying roller and a registration roller are located in sequential order from an upstream side.

The sheet conveying unit 7 includes a conveying frame and an endless conveying belt and is configured to ascent/descent in upward and downward directions between a print position close to recording heads 13 described below in printing operation and an evacuation position separate from the recording heads 13 in non-printing operation. To the conveying frame, a driving roller, a following roller and a tensioning roller are rotatably arranged and the conveying belt is wound around the driving roller, the following roller and the tensioning roller so as to convey the sheet from a right side to a left side. Inside the conveying belt, an air sucking part is arranged. In the conveying belt, a lot of air intake holes are provided and the air sucking part sucks air above the conveying belt to the inside the conveying belt.

In a left part inside the printer body 2, a sheet conveying part 8 is provided to continue from the left side from the sheet conveying unit 7 at the print position and, above the sheet conveying part 8, a drying device 9 is provided. At the left side of the sheet conveying part 8, an ejecting roller 10 is provided and, near the ejecting roller 10 and on a left face of the printer body 2, an ejecting port 11 is provided. In addition, on the left face of the printer body 2, an ejected sheet tray protruded from a lower side of the ejecting port 11 to the left side is provided.

Moreover, in a center part inside the printer body 2, four recording heads 13 (13K, 13C, 13M, 13Y) are juxtaposed above the sheet conveying unit 7. The four recording heads 13 face to an upper face of the conveying belt of the sheet conveying unit 7 in the printing operation to eject inks of black, cyan, magenta and yellow, respectively. For example, the four recording heads 13 are located in sequential order from the upstream side (the right side) in the conveying direction of the sheet.

In a left lower part inside the printer body 2, four ink containers 14 (14K, 14C, 14M, 14Y) are juxtaposed. The four ink containers 14K, 14C, 14M, 14Y contain inks of black, cyan, magenta and yellow, respectively. For example, the four ink containers 14K, 14C, 14M, 14Y are located as shown in FIG. 2 in sequential order from a lower side. When the left lower side cover 5 is opened, container installed parts (refer to FIG. 3) of the respective ink containers 14 arranged in the left lower part inside the printer body 2 are exposed and the respective ink containers 14 become conditions attachable/detachable with respect to the respective container installed parts in the forward and backward directions.

Incidentally, the recording head 13 and the ink container 14 for the same color ink are connected via a sub ink tank and others. The ink contained in each ink container 14 is constantly stored in the sub ink tank, and then, supplied to each recording head 13 by a pump.

In a left upper part of the printer body 2, the cap unit 15 and the wiper unit 16 are provided. The cap unit 15 and the wiper unit 16 are located at waiting positions at a left side from the sheet conveying unit 7 in the printing operation. Moreover, when the sheet conveying unit 7 is positioned at the evacuation position in the non-printing operation, the cap unit 15 and the wiper unit 16 become conditions movable in left and right directions, and then, any one of the cap unit 15 and the wiper unit 16 can move a processing position above the sheet conveying unit 7 and below the recording heads 13.

The cap unit 15 includes cam members 15*a* and covers the recording heads 13 by the cam members when the cap unit 15 is moved to the processing position. The wiper unit 16 includes wiper members 16*a* and a waste ink tray 16*b*, and the wiper members 16*a* and the waste ink tray 16*b* are located below the recording heads 13 when the wiper unit 16 is moved to the processing positions. At this time, purge process or cleaning process of the recording heads 13 is carried out and waste ink caused by the purge process and the cleaning process is collected to the waste ink tray 16*b*.

Moreover, in a left lower part inside the printer body 2, the waste ink tank 17 is arranged below the ink containers 14. The waste ink tank 17 contains the waste ink caused by the purge process and the cleaning process.

Figure 4:
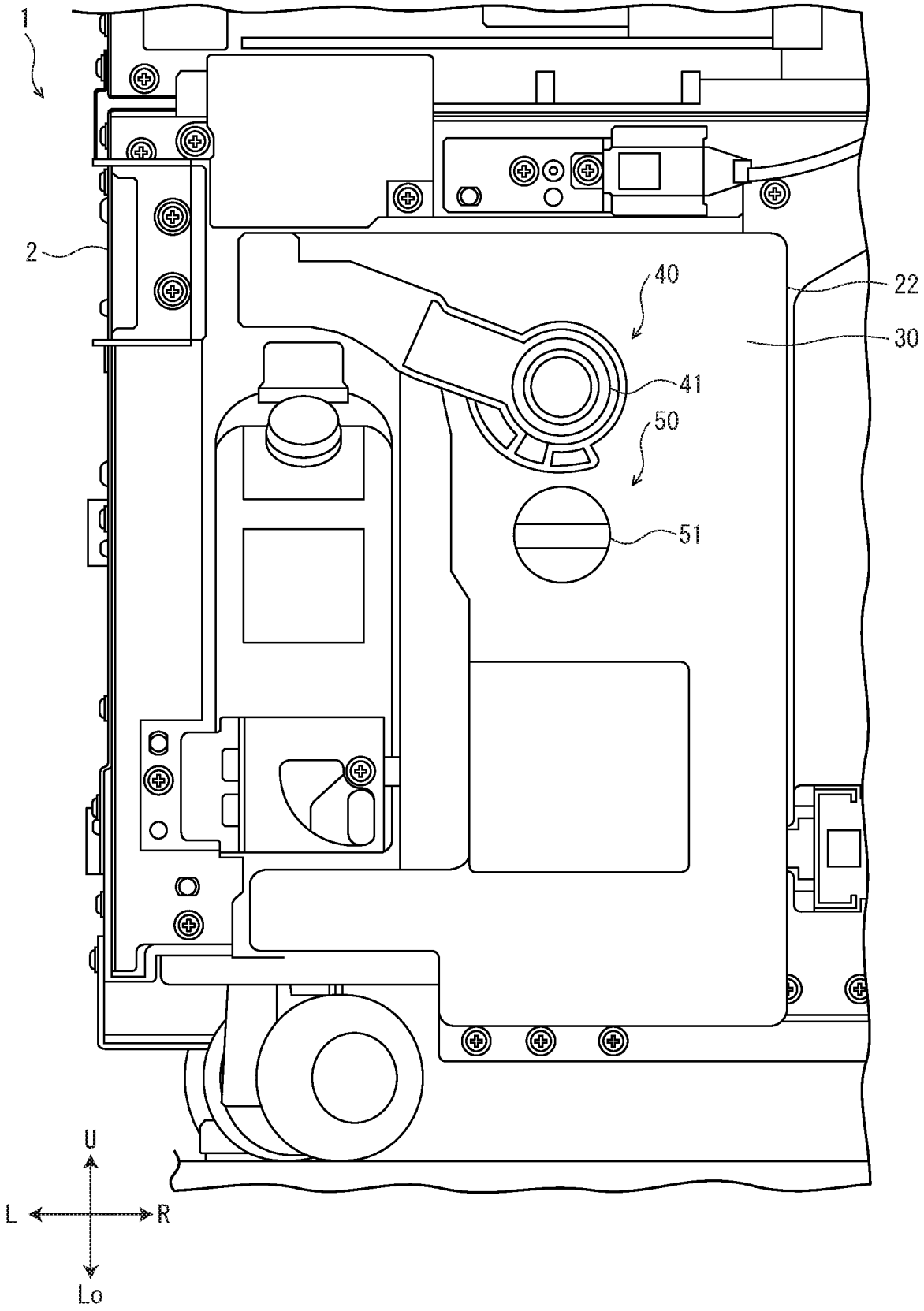
FIG. 4 is a front view showing the left lower part of the printer, in a condition that a tank cover is closed, according to the first embodiment of the present disclosure.
Figure 5:
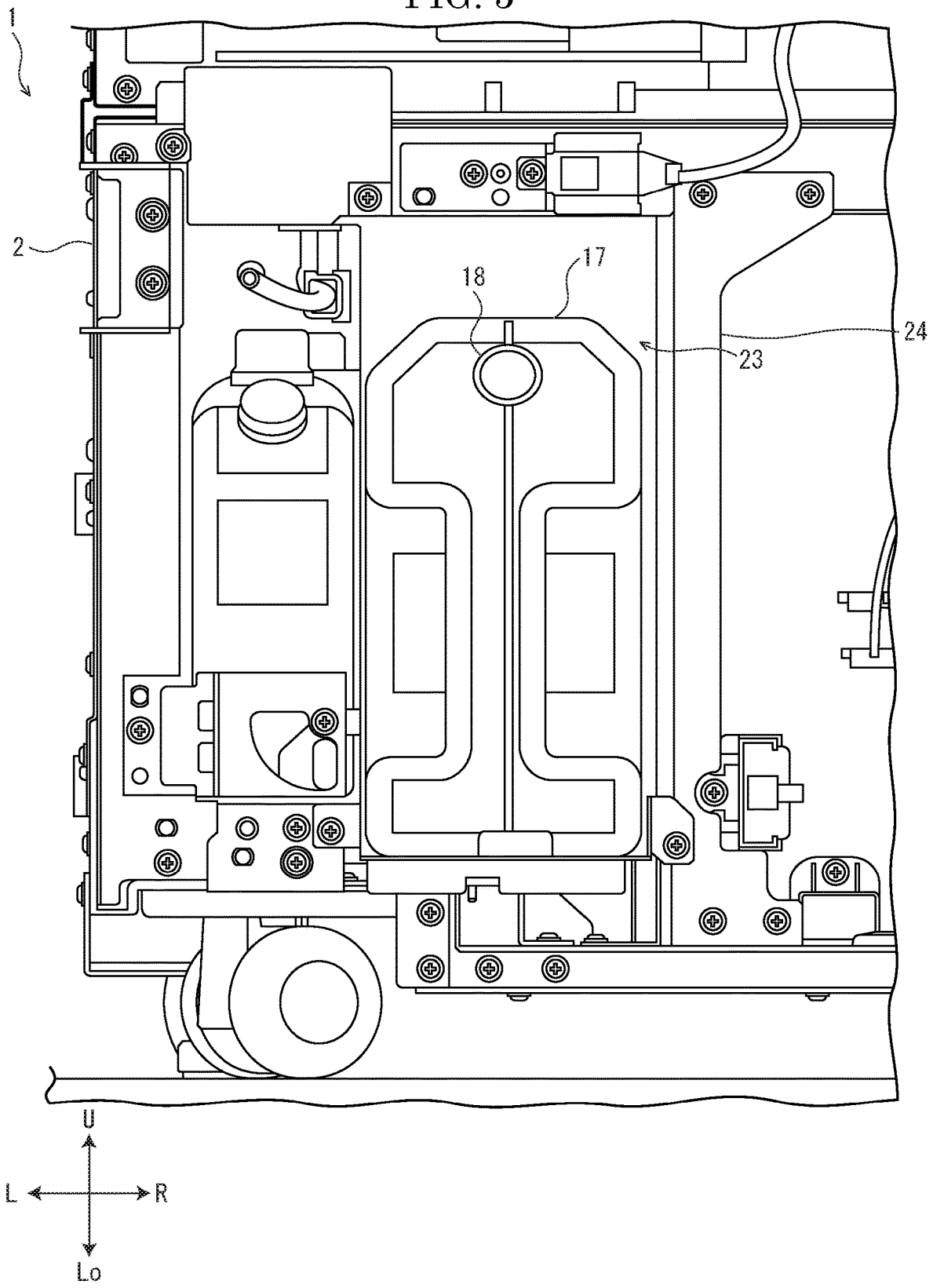
FIG. 5 is a front view showing the left lower part of the printer, in a condition that the tank cover is opened, according to the first embodiment of the present disclosure.
Figure 6:
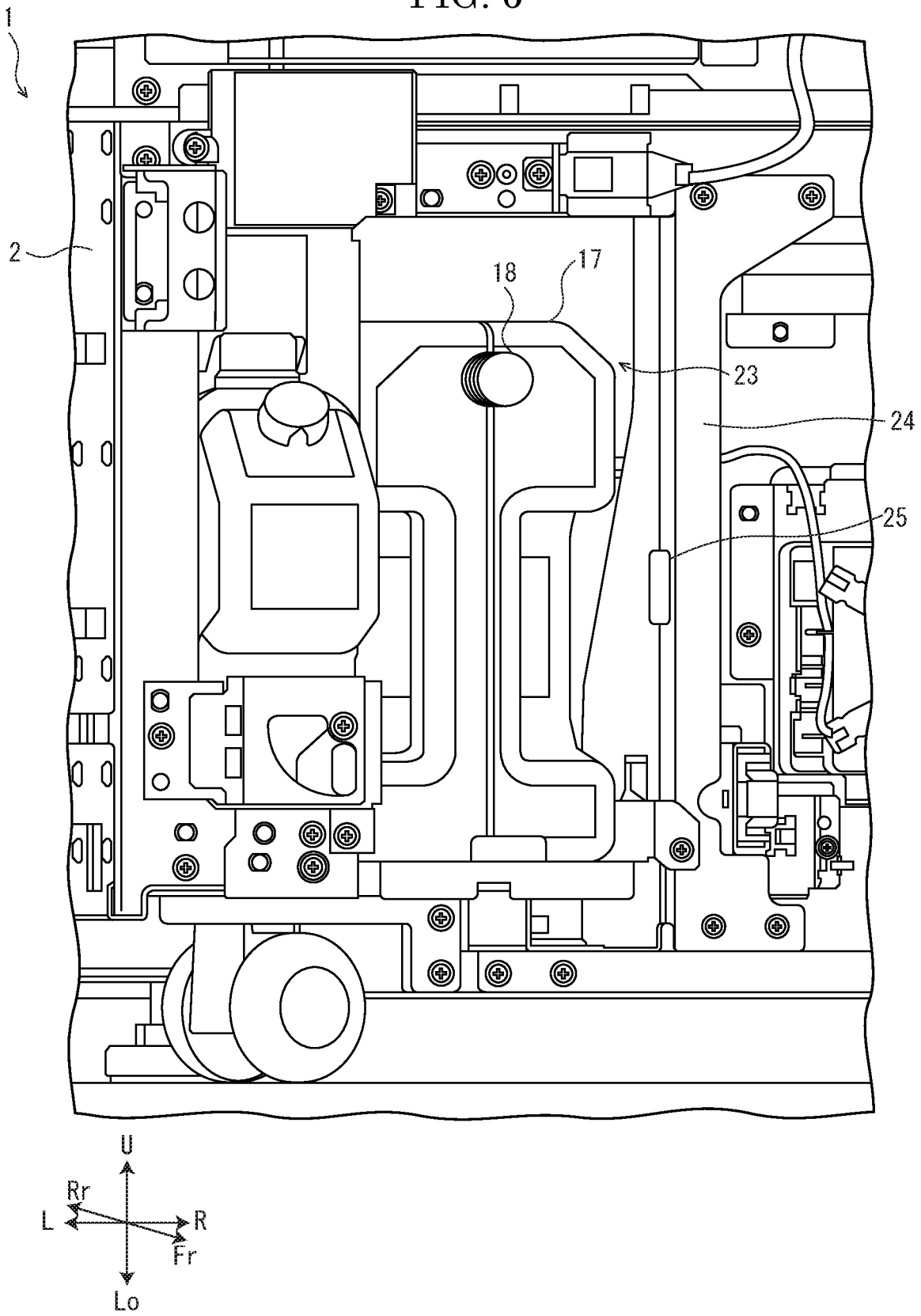
FIG. 6 is a perspective view showing the left lower part of the printer, in a condition that the tank cover is opened, according to the first embodiment of the present disclosure.
Figure 7:
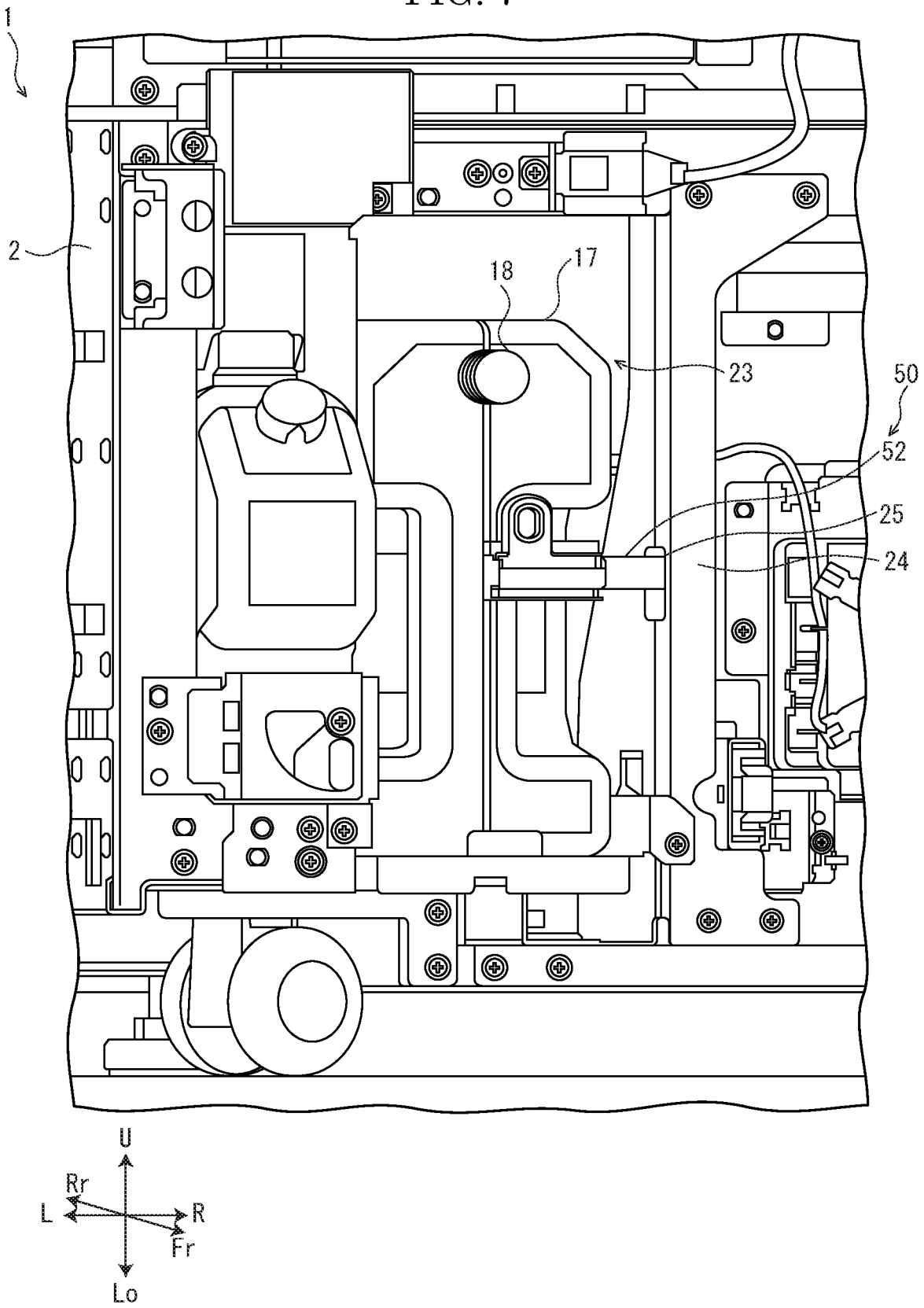
FIG. 7 is a perspective view showing the left lower part of the printer, in a condition that a locking member is attached and a cover body is omitted, according to the first embodiment of the present disclosure.
Figure 8:
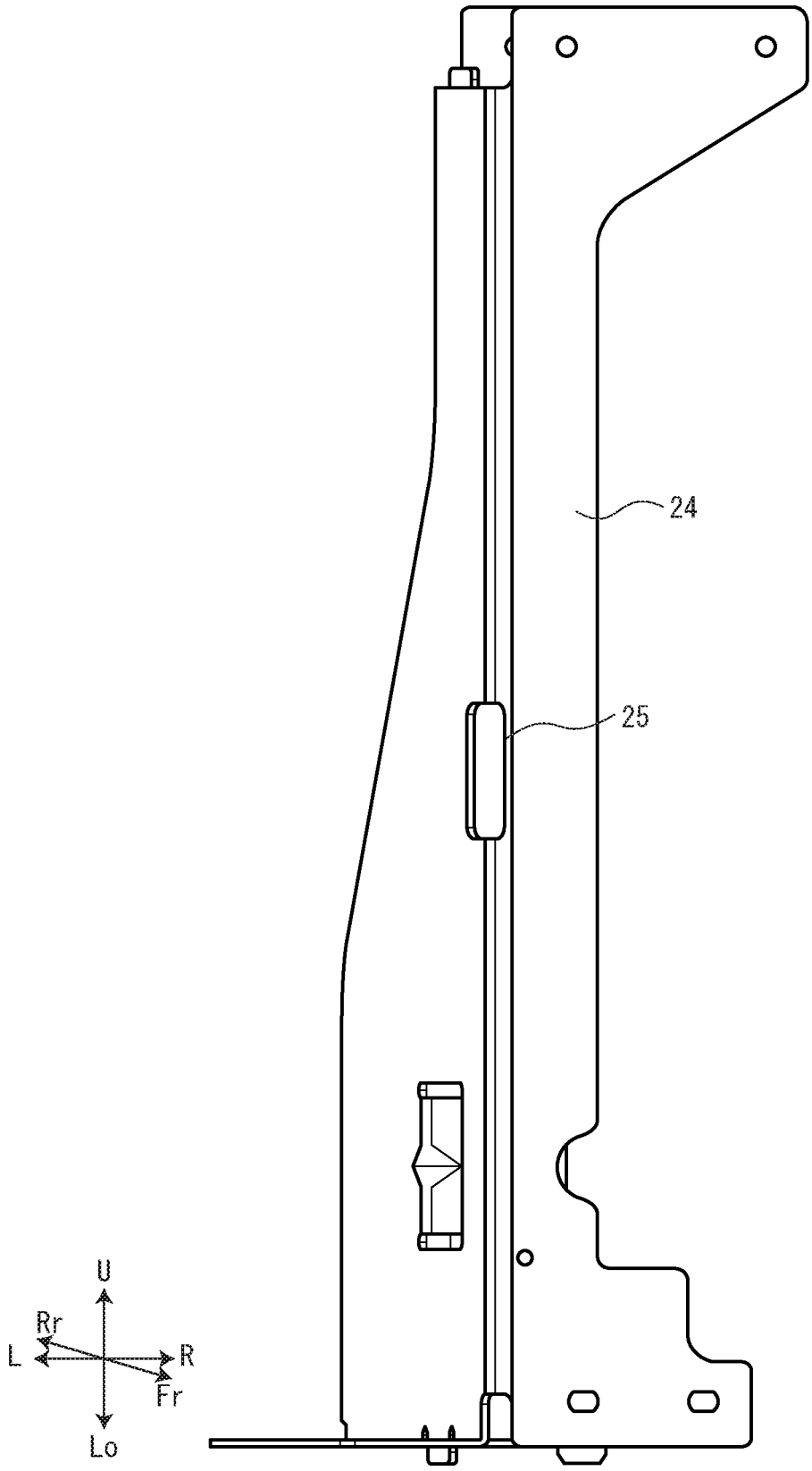
FIG. 8 is a front view showing a supporting plate constituting a tank installed part in the left lower part of the printer according to the first embodiment of the present disclosure.
Figure 9:
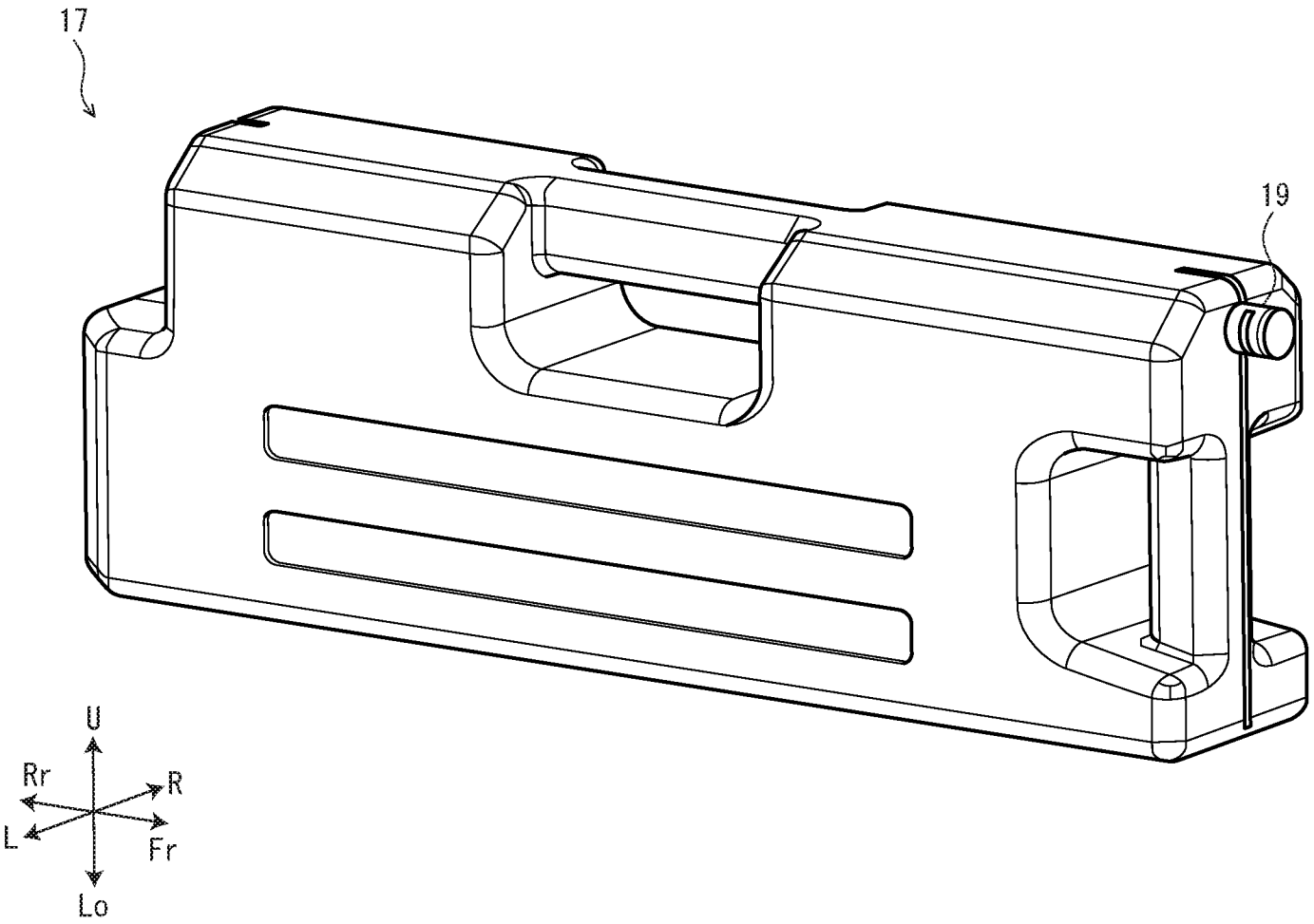
FIG. 9 is a perspective view showing a waste ink tank as viewed from a left side in the printer according to the first embodiment of the present disclosure.
Figure 10:
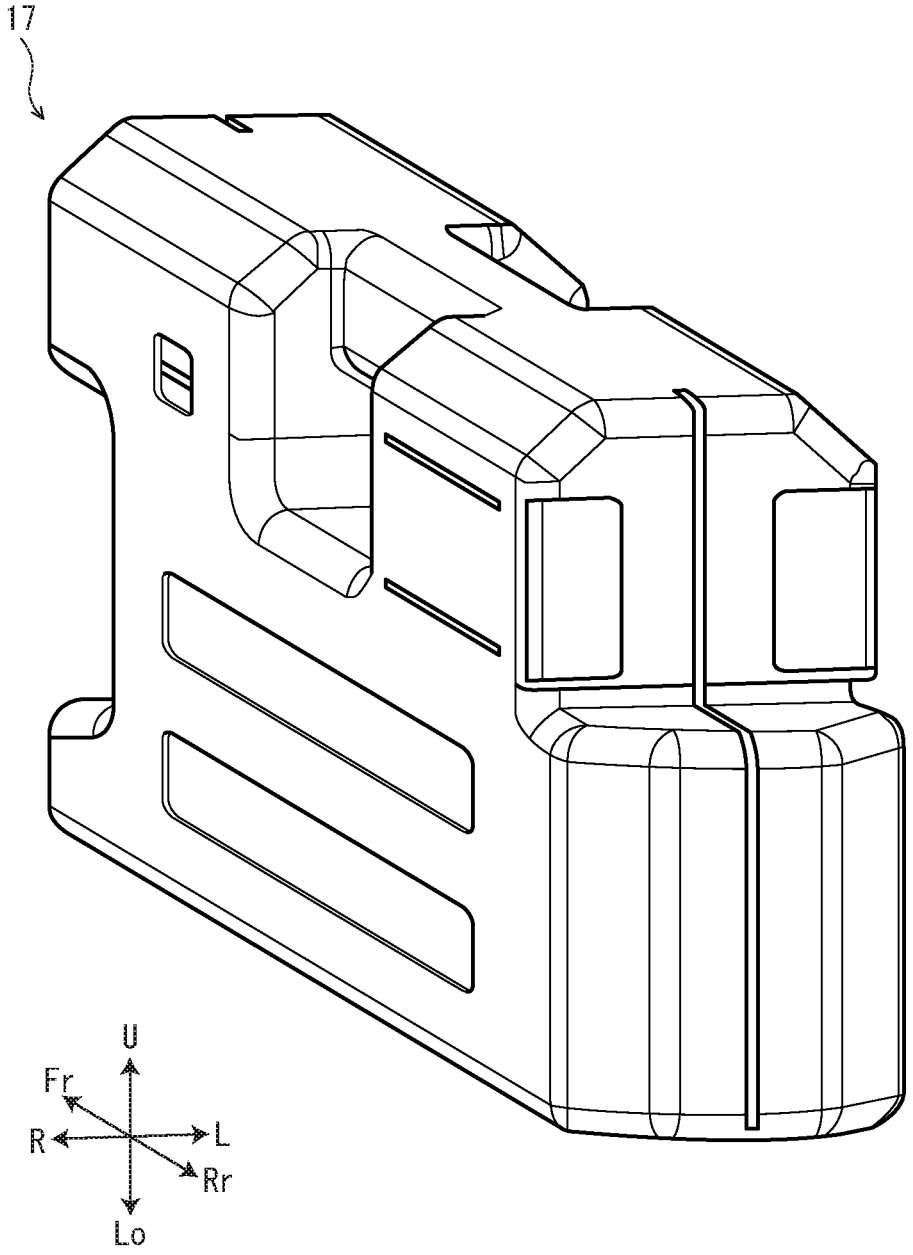
FIG. 10 is a perspective view showing the waste ink tank as viewed from a rear side in the printer according to the first embodiment of the present disclosure.
Figure 11:
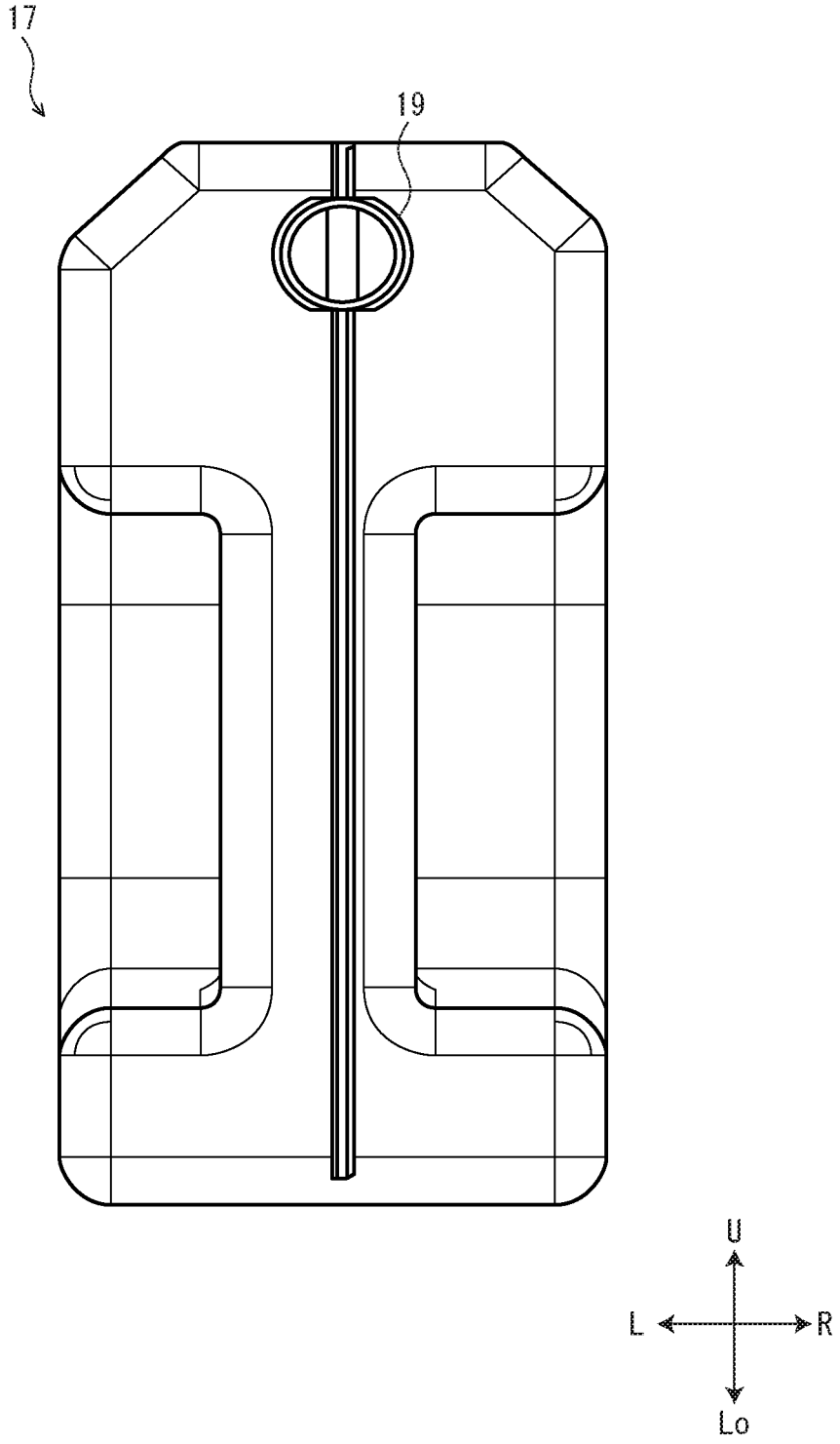
FIG. 11 is a front view showing the waste ink tank in the printer according to the first embodiment of the present disclosure.
Figure 12:
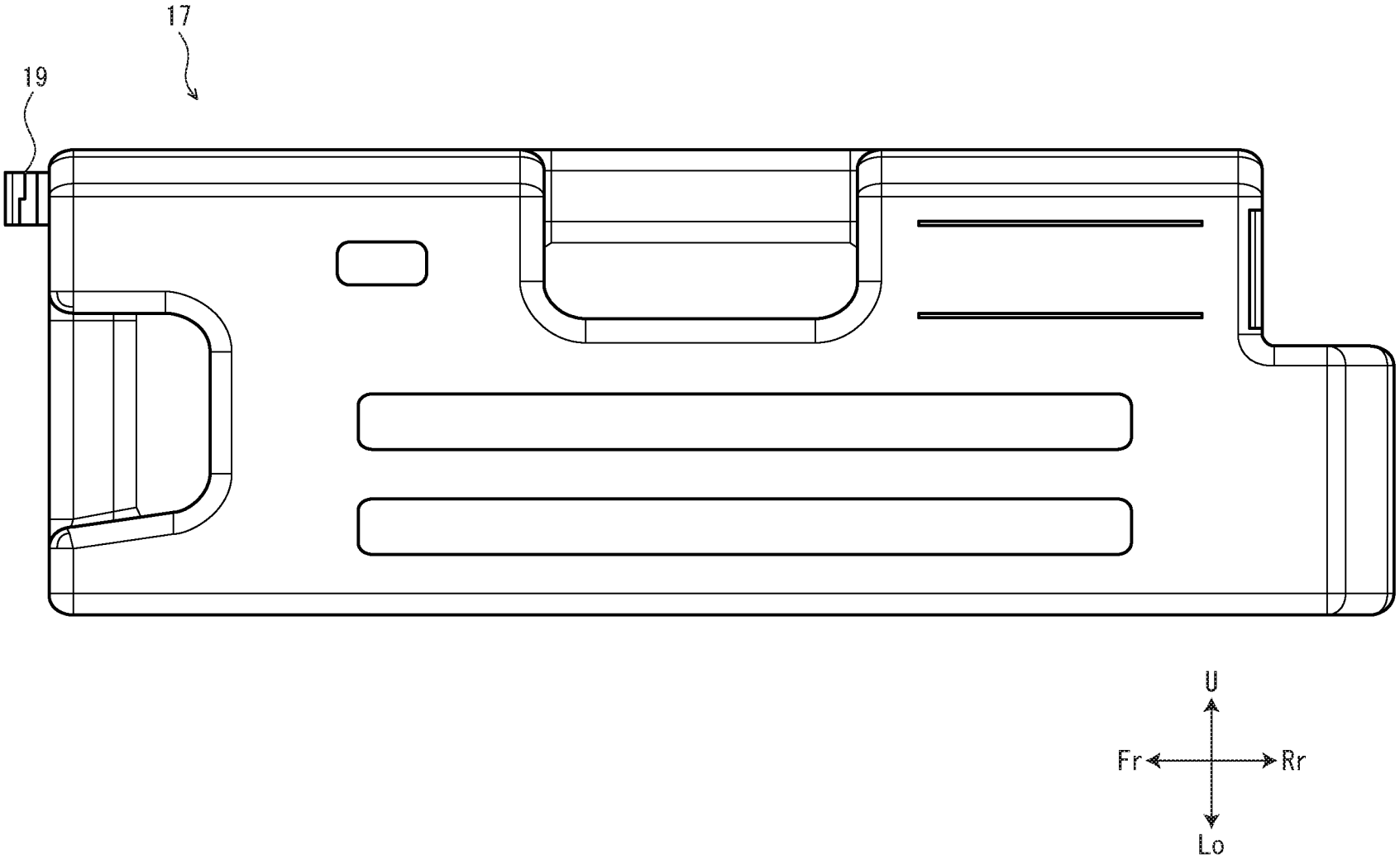
FIG. 12 is a right side view showing the waste ink tank in the printer according to the first embodiment of the present disclosure.
Figure 13:
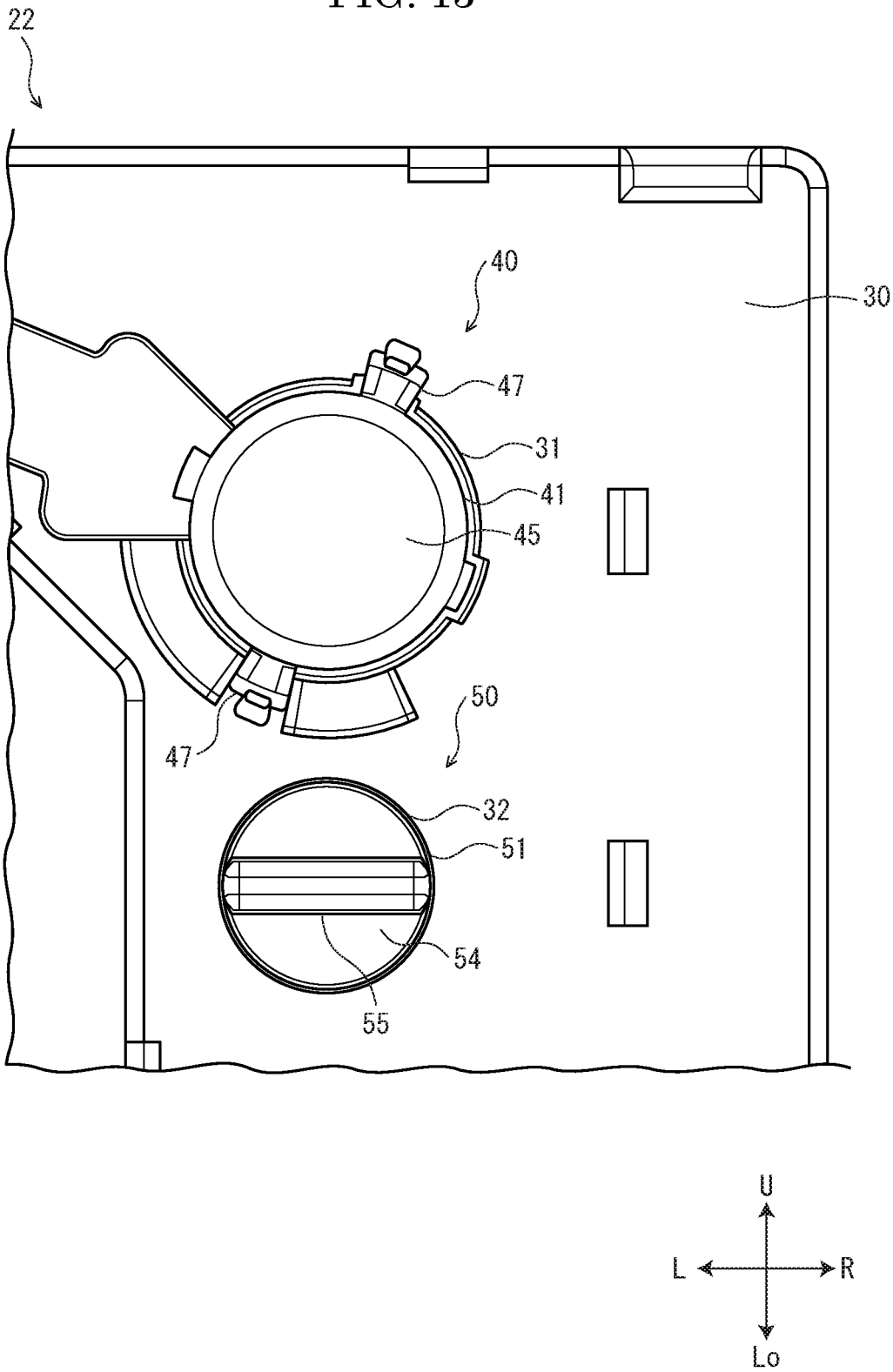
FIG. 13 is a front view showing a part of the tank cover in the printer according to the first embodiment of the present disclosure.

In the printer body 2, as shown in FIGS. 2, 3 and 4, a tank cover 22 covering the waste ink tank 17 is openably/closably provided. The tank cover 22 is arranged inside the left lower side cover 5 and exposed when the left lower side cover 5 is opened. When the tank cover 22 is opened, as shown in FIGS. 5, 6 and 7, a tank installed part 23 for the waste ink tank 17 arranged inside the printer body 2 is exposed and the waste ink tank 17 becomes a condition attachable/detachable with respect to the tank installed part 23 in the forward and backward directions. A right front edge part of the tank installed part 23 is composed of a supporting plate 24 provided in the printer body 2, as shown in FIGS. 5-8, and, in the supporting plate 24, a locking hole 25 engaging a locking member 52 of a cover locking part 50 described below is formed.

The waste ink tank 17 is formed, for example, as shown in FIGS. 9, 10, 11 and 12, in a rectangular parallelepiped shape elongated in the forward and backward directions and, in a front face of the waste ink tank 17, an inflow port 18 for the waste ink is formed. When the waste ink tank 17 is replaced, a cap 19 is attached to the inflow port 18, and thereby, the inflow port 18 is closed. On the other hand, when the waste ink tank 17 is installed into the tank installed part 23 and the tank cover is closed, the cap 19 is detached from the inflow port 18, and thereby, the inflow port 18 is opened.

Incidentally, the waste ink tray 16*b* of the wiper unit 16 and the inflow port 18 are connected via a tube 20 (refer to FIG. 2) and a nozzle 21 (refer to FIG. 15), and the waste ink collected in the waste ink tray 16*b* is ejected into the waste ink tank 17 via the tube 20 by a pump.

Next, the printing operation (image forming operation) of the printer 1 having such a configuration will be described. When the printer 1 receives image data from an external computer or the like, the sheet stored in the sheet feeding cartridge 3 is picked up and fed to the conveying path 6 by the sheet feeding roller. The sheet fed to the conveying path 6 is conveyed to a downstream side of the conveying path 6 by the conveying roller, and then, fed from the conveying path 6 to the upper face of the conveyance belt of the sheet conveying unit 7 at the print position by the registration roller. The sheet is absorbed to the upper face of the conveyance belt by suction force of the air sucking part.

On the other hand, to each recording head 13, the ink is supplied from each ink container 14. Each recording head 13 ejects the ink to the sheet absorbed on the conveying belt on the basis of the information of the image data received from the external computer or the like. Thereby, a color ink image is formed on a surface of the sheet. The sheet having the color ink image is conveyed by the sheet conveying part 8, the ink on the surface is dried by the drying device 9, and then, the sheet is ejected on the ejected sheet tray 12 via the ejecting port 11 by the ejecting roller 10.

In the first embodiment, the printer 1 includes a waste ink conveying device 1*a* conveying the waste ink caused in the recording head 13 to the waste ink tank 17. The waste ink conveying device 1*a* is composed of the waste ink tray 16*b*, the tube 20, the tank installed part 23 (including the supporting plate 24), the tank cover 22, the waste ink tank 17 and others.

Next, the tank cover 22 will be described. In the description of the tank cover 22, front, rear, left and right indicate respective locations in a case the tank cover 22 in a closing state is a criterion. Moreover, a clockwise direction and a counterclockwise direction indicate directions as viewed from the front side. The tank cover 22 includes, as shown in FIGS. 3, 4, 13, 14, 15 and other figures, a cover body 30, the nozzle 21, a nozzle operating part 40 and the cover locking part 50. Incidentally, the nozzle 21, the nozzle operating part 40 and the cover locking part 50 are arranged mainly at a rear side of the cover body 30 and protected by being covered with an inside cover (not shown) attached at the rear side of the cover body 30.

The cover body 30 is made of a roughly plate-like member. The cover body 30 is attached to the printer body 2 with a turning shaft attached at a left end of the cover body 30, and opened/closed by turning with respect to the printer body 2. When the cover body 30 is closed, the tank cover 22 becomes the closing state, and the tank installed part 23 and the waste ink tank 17 is covered by the cover body 30. On the other hand, when the cover body 30 is opened, the tank cover 22 becomes an opening state, and the tank installed part 23 and the waste ink tank 17 is exposed, and the waste ink tank 17 becomes a condition capable of replacing.

Figure 14:
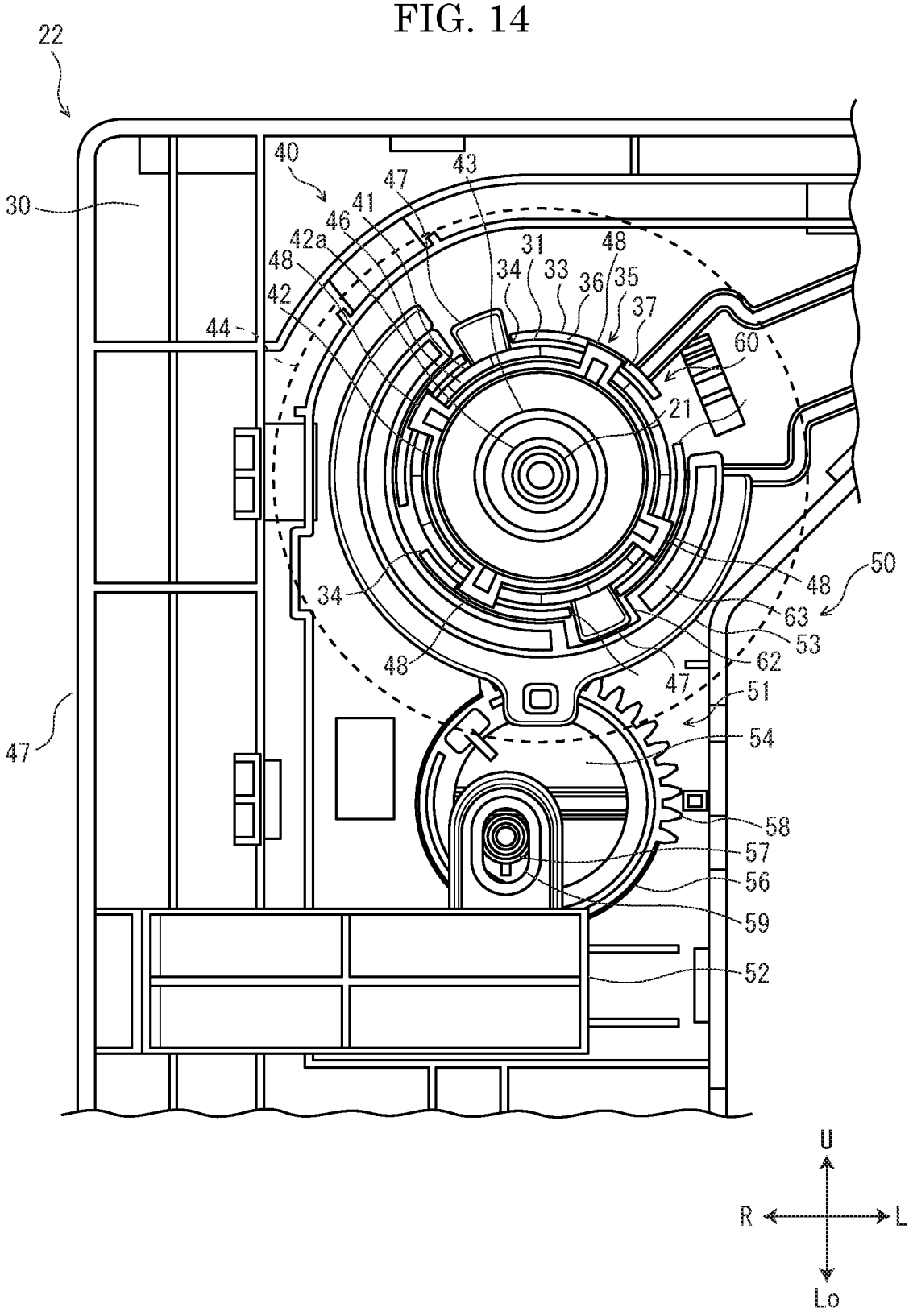
FIG. 14 is a rear view showing a part of the tank cover in the printer according to the first embodiment of the present disclosure.

In the cover body 30, a circular nozzle operating hole 31 and a circular locking operating hole 32 are opened. The locking operating hole 32 is arranged below the nozzle operating hole 31. In a rear face of the cover body 30, as shown in FIGS. 14, 15 and other figures, a cylindrical wall 33 along an edge of the nozzle operating hole 31 is erected to the rear side and the cylindrical wall 33 has an inner diameter similar to the nozzle operating hole 31.

In a rear end of the cylindrical wall 33, four slits 34 extended to the front end are formed at the upper side, the lower side, the left side and the right side at regular intervals, and each slit 34 is cut out just before the edge of the nozzle operating hole 31. Moreover, in the rear end of the cylindrical wall 33, engaging gaps 35 are formed and each engaging gap 35 is arranged between two adjacent slits 34. Each engaging gap 35 is composed of a first inclined face 36 inclined forwardly toward the counterclockwise direction and a roughly vertical face. Further, at a downstream side from each engaging gap 35 in the counterclockwise direction, a second inclined face 37 inclined forwardly toward the counterclockwise direction is formed. Incidentally, the first inclined face 36 is longer than the second inclined face 37.

The nozzle 21 is formed so as to be bent in an L-shape and connected to the tube 20 at a proximal end of the nozzle 21. In a distal end of the nozzle 21, a stopper, such as a barb, is formed and, when the nozzle 21 is inserted into the inflow port 18 of the waste ink tank 17, the nozzle 21 hardly falls out of the inflow port 18.

Figure 15:
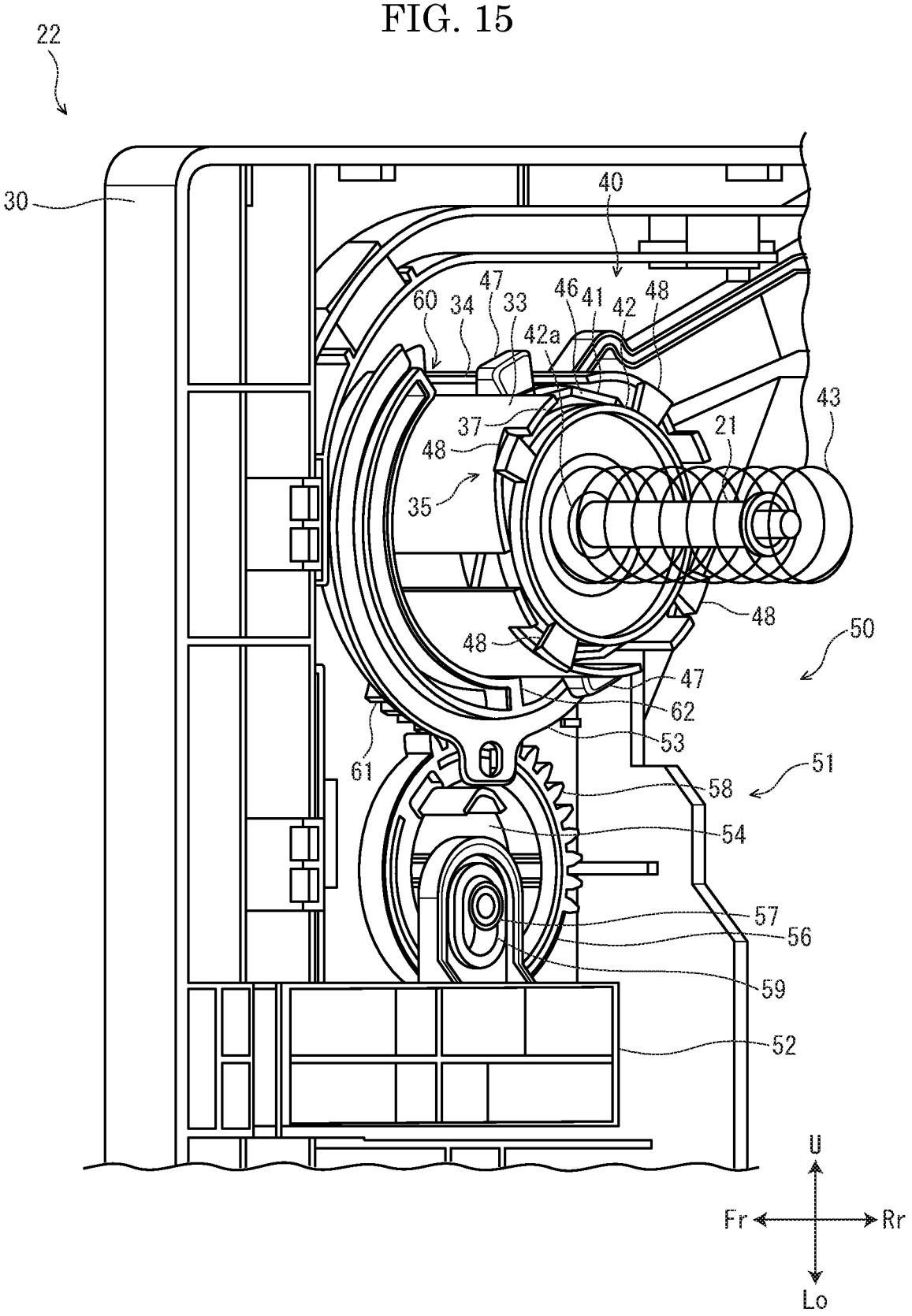
FIG. 15 is a perspective view showing a part of the tank cover as viewed from the rear side in the printer according to the first embodiment of the present disclosure.
Figure 16:
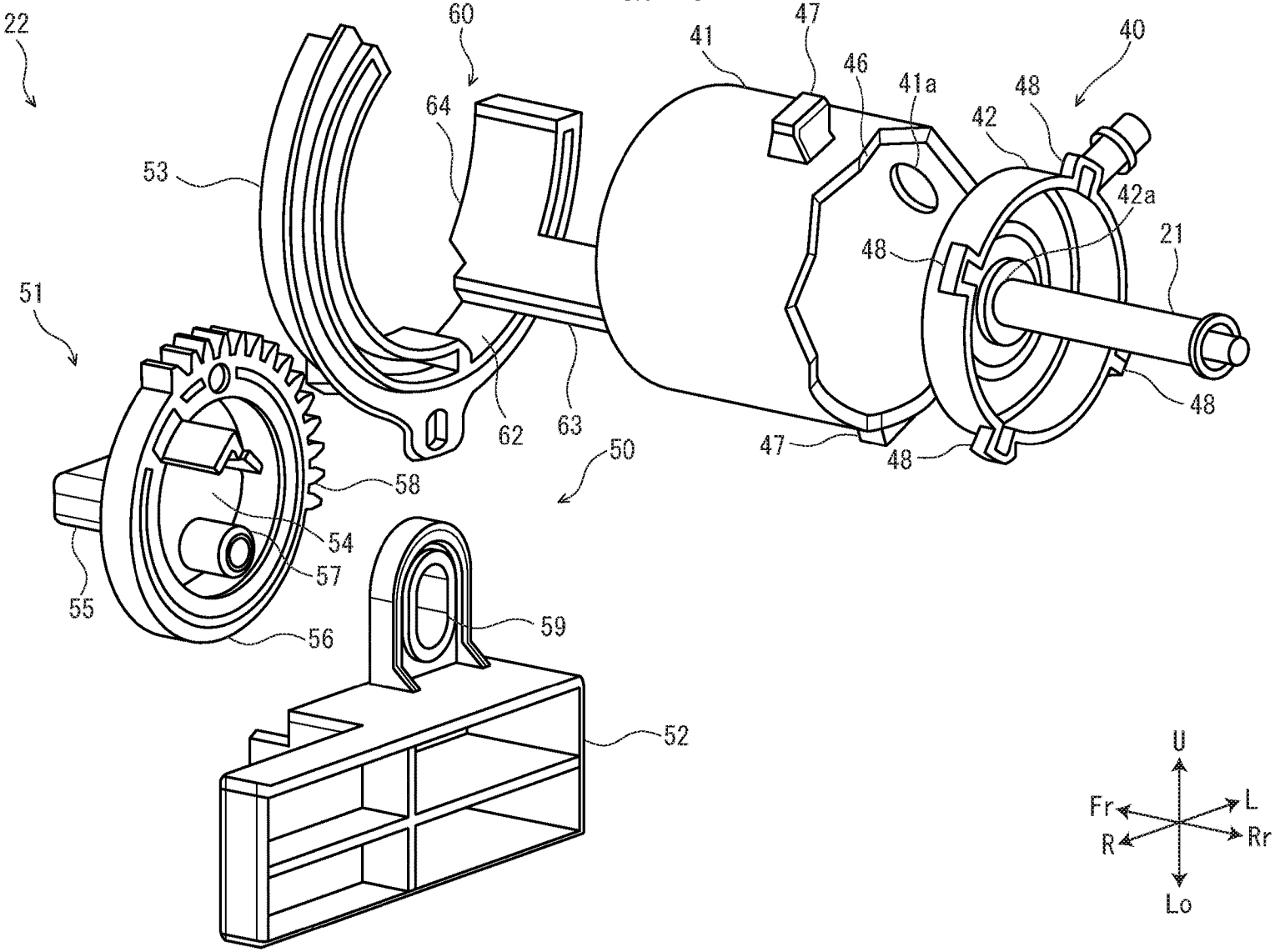
FIG. 16 is an exploded perspective view showing a nozzle operating part and a cover locking part as viewed from the rear side in the tank cover of the printer according to the first embodiment of the present disclosure.

As shown in FIGS. 15, 16 and other figures, the nozzle operating part 40 includes a pushing member 41, a nozzle cam 42, a cam pushing spring 43 and an operating part cover 44. The cover locking part 50 includes a locking lever 51, the locking member 52 and a locking cam 53.

Components (the pushing member 41, the nozzle cam 42, the cam pushing spring 43 and the operating part cover 44) of the nozzle operating part 40 will be described.

The pushing member 41 is formed in a cylindrical shape shorter than the cylindrical wall 33 in the forward and backward directions. The pushing member 41 has an outer diameter slightly smaller than the inner diameters of the nozzle operating hole 31 and the cylindrical wall of the cover body 30. The pushing member 41 is a nozzle supporting part supporting the nozzle 21 and, in a left face of the pushing member 41, a nozzle hole 41*a* allowing for insertion of the nozzle 21 is formed. A front end of the pushing member 41 is closed by a pressing face 45 and, in a rear end of the pushing member 41, a serrated sliding face 46 is formed so as to have symmetrical inclined faces continuously. In a rear end of an outer circumference face of the pushing member 41, a pair of first protrusions 47 (a protrusion) protruded in an outward radial direction are formed at the upper side and the lower side.

Each first protrusion 47 has a dimension capable of fitting in the slit 34 of the cylindrical wall 33. The pushing member 41 is fitted in the nozzle operating hole 31 and the cylindrical wall 33 in a condition that the first protrusions 47 are respectively fitted in the upper and lower slits 34, and then, can move along the cylindrical wall 33 in the forward and backward directions. Incidentally, each first protrusion 47 is protruded outside an outer circumference face of the cylindrical wall 33 in the outward radial direction and, when each first protrusion 47 is stopped at the edge of the nozzle operating hole 31, the pushing member 41 is restrained from moving to the front side.

The nozzle cam 42 is formed in a disk shape and has an outer diameter slightly smaller than the inner diameters of the nozzle operating hole 31 and the cylindrical wall 33 of the cover body 30, i.e. the same outer diameter as the push member 41. In a center of the nozzle cam 42, a nozzle hole 42*a* allowing for insertion of the nozzle 21 is formed and, in a rear face of the nozzle cam 42, a supporting groove supporting a front end of the cam pushing spring 43 is formed around the nozzle hole 42*a*. On an outer circumference face of the nozzle cam 42, four second protrusions 48 protruded in the outward radial direction are formed at regular intervals.

Incidentally, the nozzle operating hole 31 and the cylindrical wall 33 of the cover body 30 is configured so that, in a case where the tank cover 22 is in the closing state, a position of the nozzle hole 42*a* of the nozzle cam 42 corresponds to a position of the inflow port 18 of the waste ink tank 17 installed in the tank installed part 23.

Each second protrusion 48 has a dimension capable of fitting in the slit 34 of the cylindrical wall 33. The nozzle cam 42 is fitted in the cylindrical wall 33 at a rear side from the pushing member 41 and, in a case where each second protrusion 48 is fitted in the slit 34, can move along the cylindrical wall 33 in the forward and backward directions. Incidentally, each second protrusion 48 is protruded outside an inner circumference face and inside the outer circumference face of the cylindrical wall 33 in the outward radial direction. Moreover, in a case where each second protrusion 48 is engaged with each engaging gap 35 of the cylindrical wall 33, the nozzle cam 42 is restrained from moving to the front side.

The pushing member 41 and the nozzle cam 42 are covered, in a condition being fitted in the cylindrical wall 33, together with the cylindrical wall 33 by the operating part cover 44 from the rear side. Between the nozzle cam 42 and the operating part cover 44, the cam pushing spring 43 is arranged, and the nozzle cam 42 is biased to the front side by the cam pushing spring 43. When the nozzle cam 42 in such a condition is pushed to the rear side by the pushing member 41, the nozzle cam 42 is slid so as to rotate in the counterclockwise direction along the serrated sliding face 46 of the pushing member 41. Subsequently, whenever the nozzle cam 42 is pushed by the pushing member 41, fitting of the second protrusions 48 in the slits 34 and engaging of the second protrusions 48 into the engaging gaps 35 are switched.

Incidentally, the nozzle 21 is inserted in the nozzle hole 41*a* of the push member 41 and the nozzle hole 42*a* of the nozzle cam 42 by using the L-shape of the nozzle 21. Since the nozzle 21 is positioned in the forward and backward directions by the nozzle hole 41*a* of the push member 41, the nozzle 21 is moved in the forward and backward directions as the pushing member 41 is moved in the forward and backward directions.

A notching mechanism of the nozzle 21 by the cover body 30 and the nozzle operating part 40 described above will be described. This presupposes that the tank cover 22 is in the closing state.

Figure 17B:
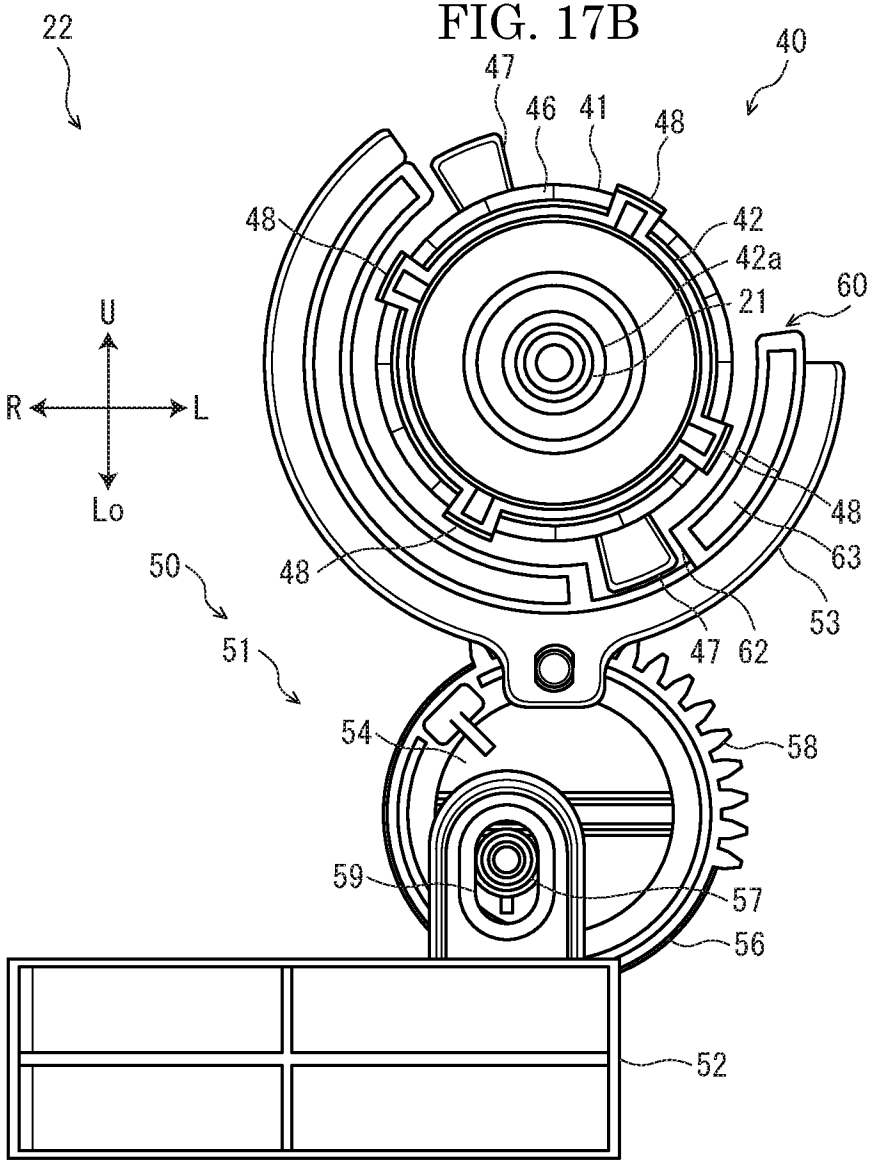
FIG. 17B is a rear view showing the nozzle in the retracting state and the cover locking part in the locking state in the tank cover of the printer according to the first embodiment of the present disclosure.
Figure 17A:
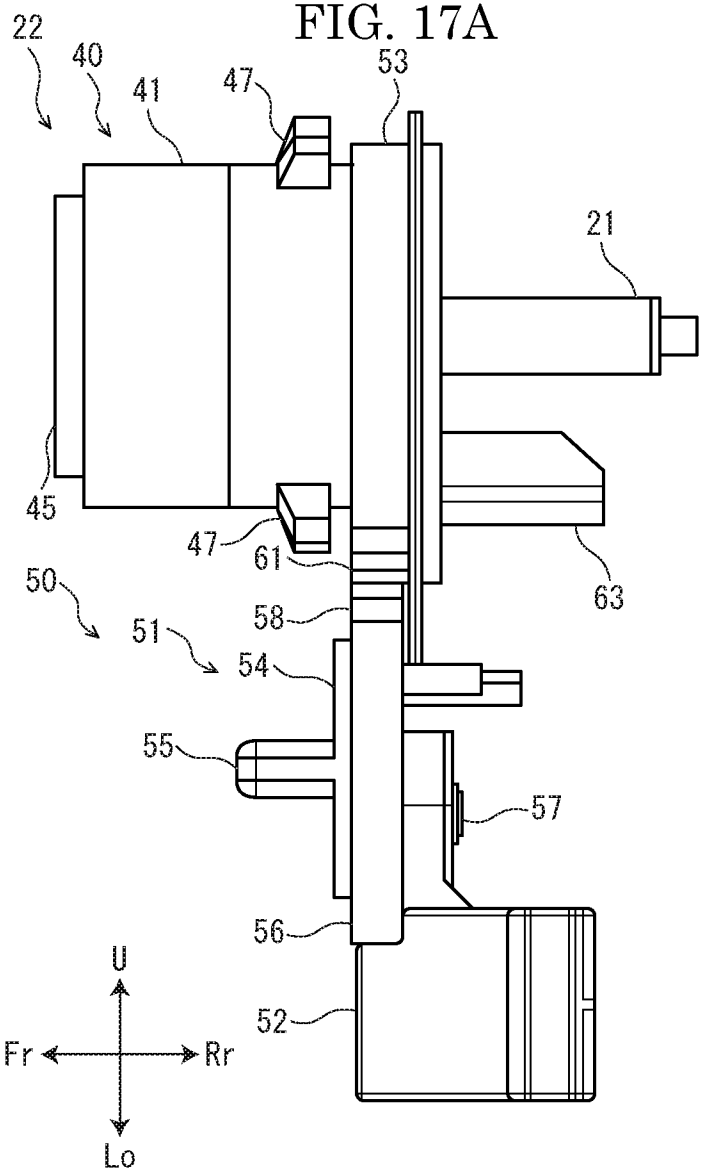
FIG. 17A is a right side view showing a nozzle in a retracting state and the cover locking part in a locking state in the tank cover of the printer according to the first embodiment of the present disclosure.
Figure 18B:
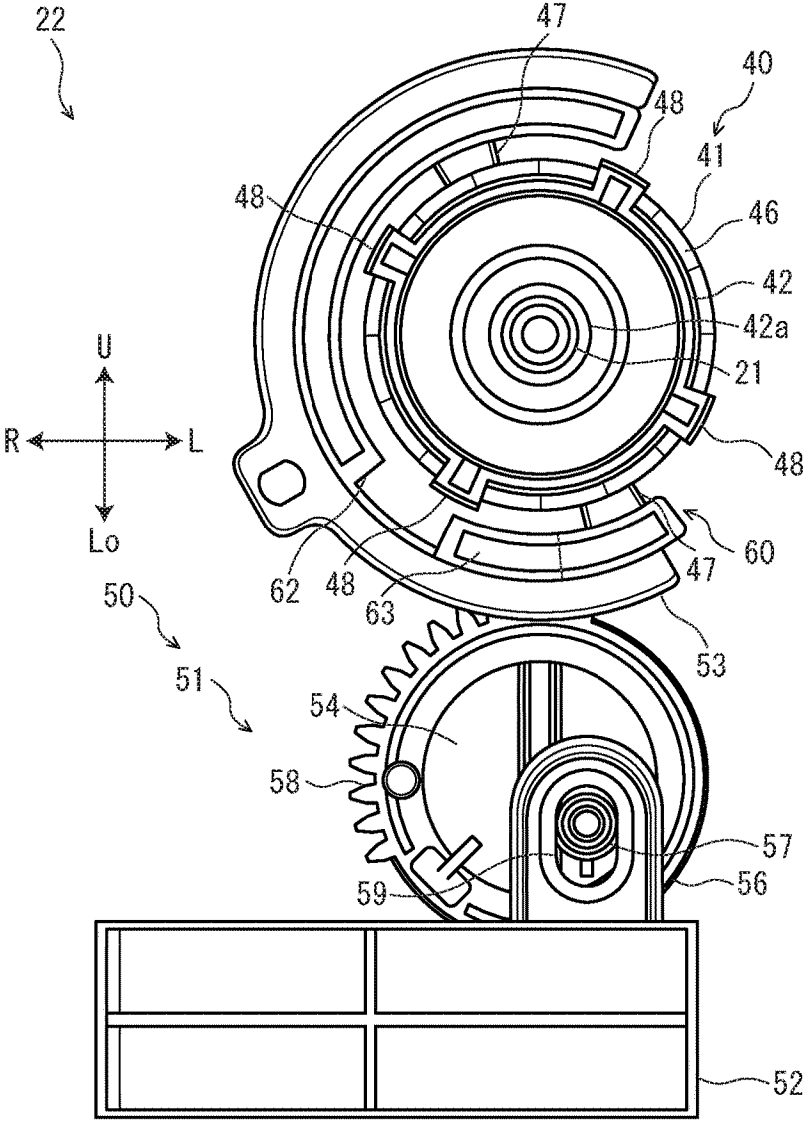
FIG. 18B is a rear view showing the nozzle in the retracting state and the cover locking part in the unlocking state in the tank cover of the printer according to the first embodiment of the present disclosure.
Figure 18A:
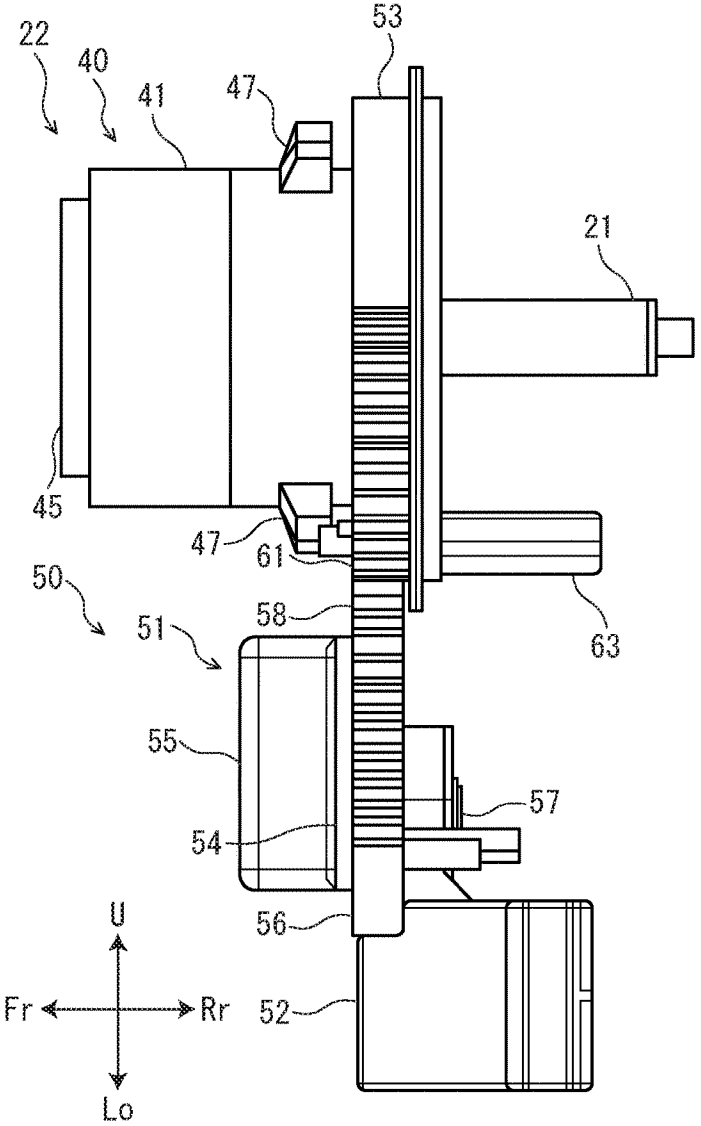
FIG. 18A is a right side view showing the nozzle in a retracting state and the cover locking part in an unlocking state in the tank cover of the printer according to the first embodiment of the present disclosure.
Figure 22:
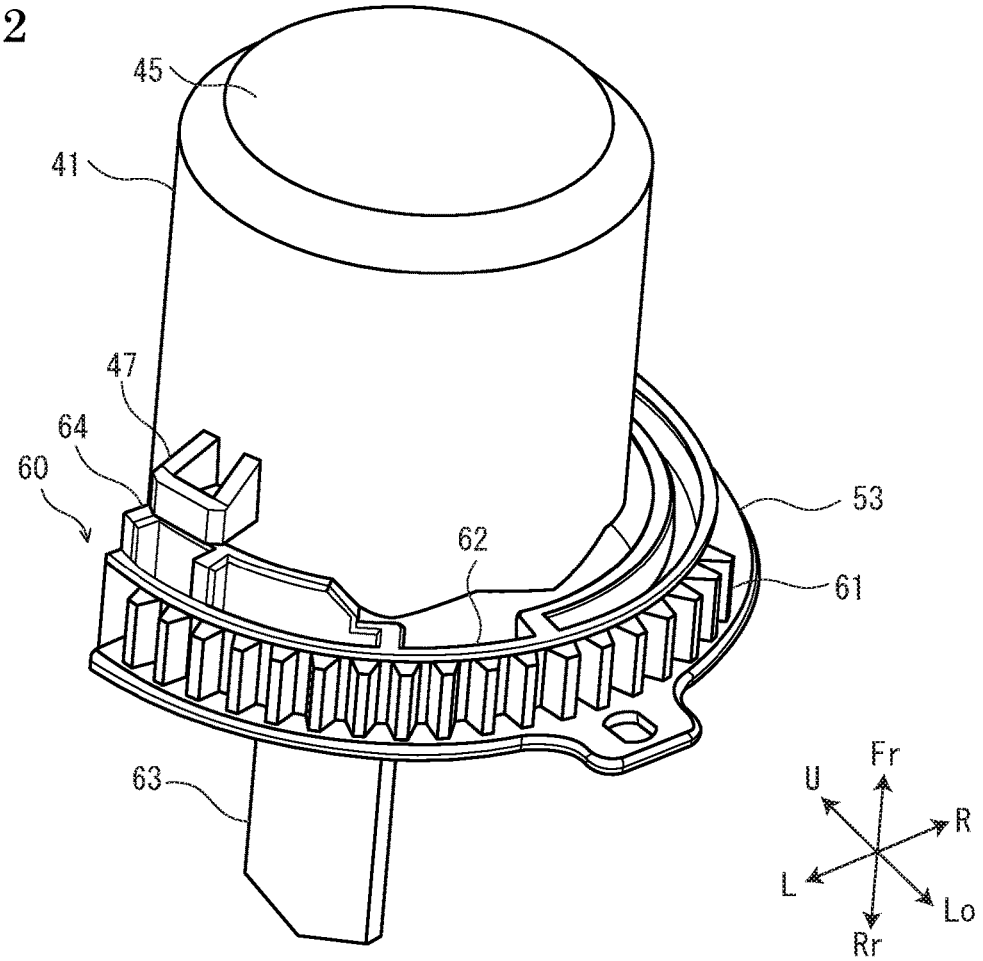
FIG. 22 is a perspective view showing a pushing member, in a condition incapable of pushing with respect to the locking cam, as viewed from the front side in the tank cover of the printer according to the first embodiment of the present disclosure.

When the second protrusions 48 of the nozzle cam 42 are fitted in the slits 34, as shown in FIGS. 17A and 18A, the pushing member 41 and the nozzle cam 42 are pushed to the front side by the cam pushing spring 43, and the nozzle 21 is positioned at a retracting position at the front side. Moreover, the pushing member 41 is protruded to the front side from a front face of the cover body 30 to indicate a retracting state of the nozzle 21. Thus, in a case where the pushing member 41 is in a nozzle retracting state, as shown in FIG. 22, the first protrusions 47 of the pushing member 41 are located at the front side from the locking cam 53 of the cover locking part 50 described below.

Figure 19B:
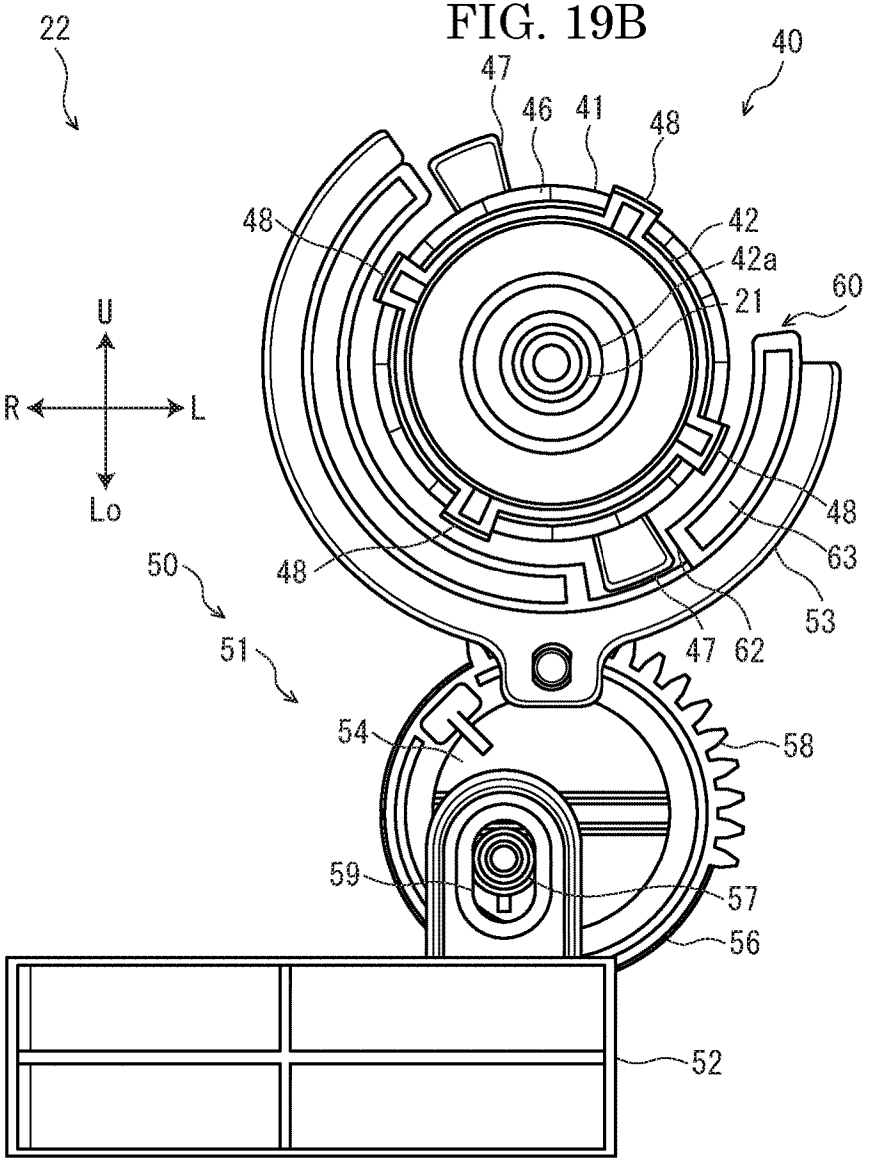
FIG. 19B is a rear view showing the nozzle in the projecting state and the cover locking part in the locking state in the tank cover of the printer according to the first embodiment of the present disclosure.
Figure 19A:
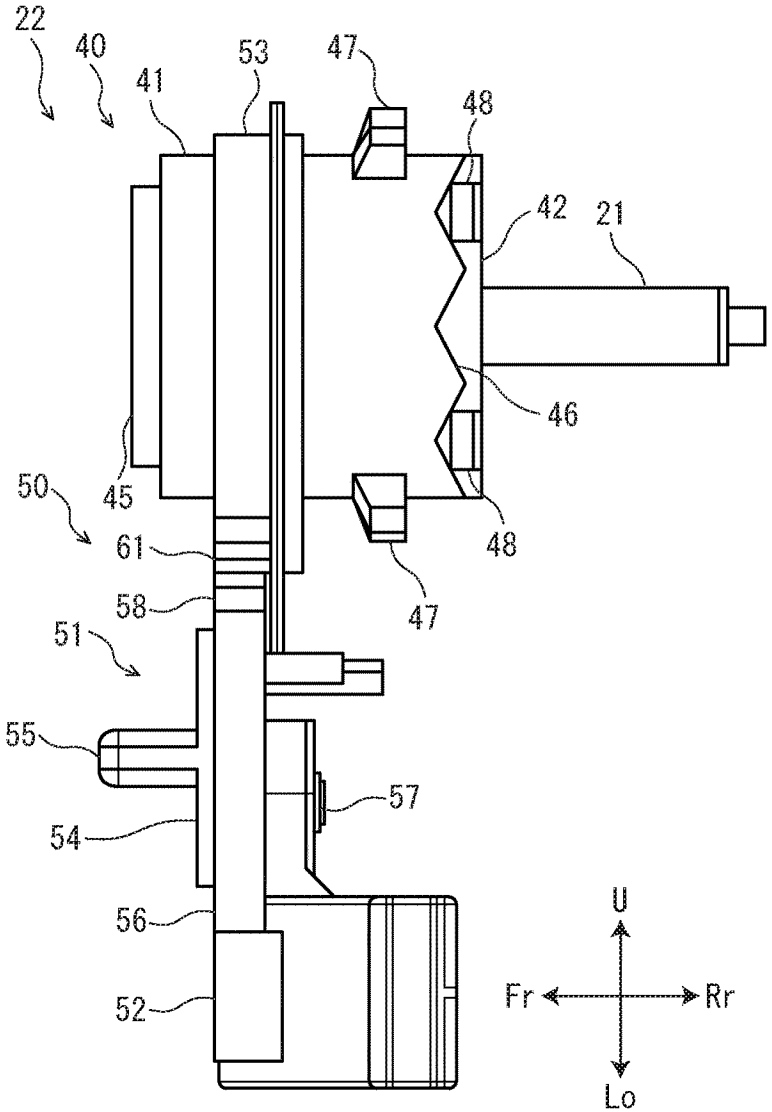
FIG. 19A is a right side view showing the nozzle in a projecting state and the cover locking part in the locking state in the tank cover of the printer according to the first embodiment of the present disclosure.
Figure 20:
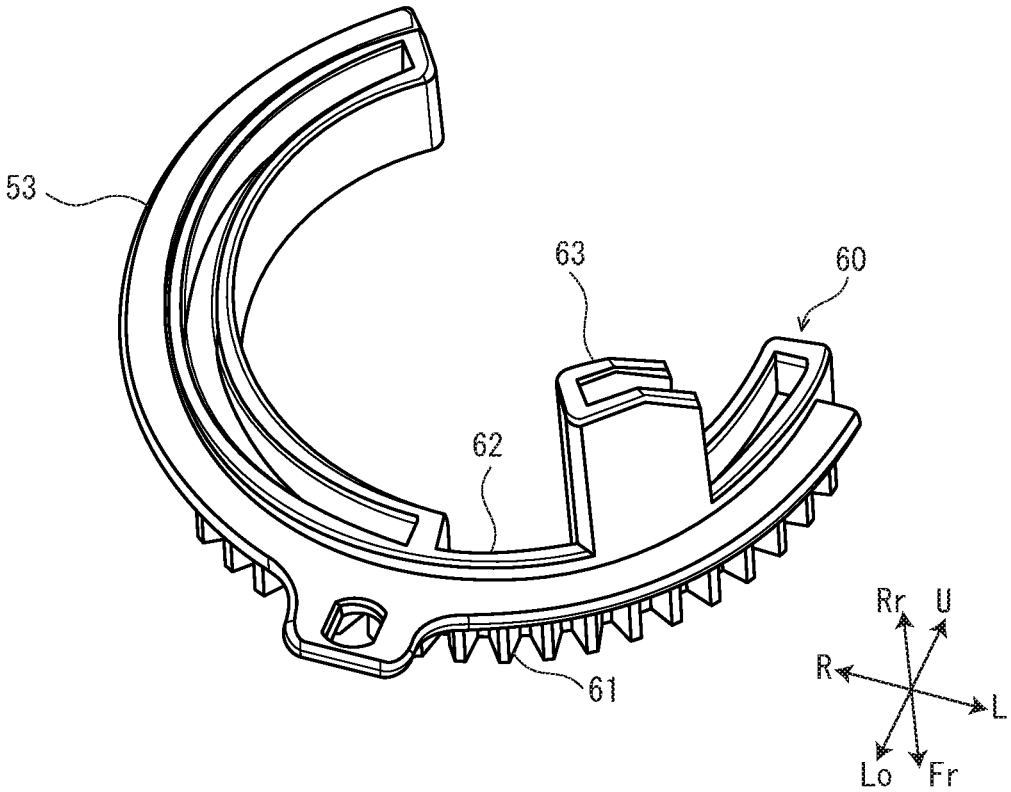
FIG. 20 is a perspective view showing a locking cam of the cover locking part as viewed from the rear side in the tank cover of the printer according to the first embodiment of the present disclosure.
Figure 21:
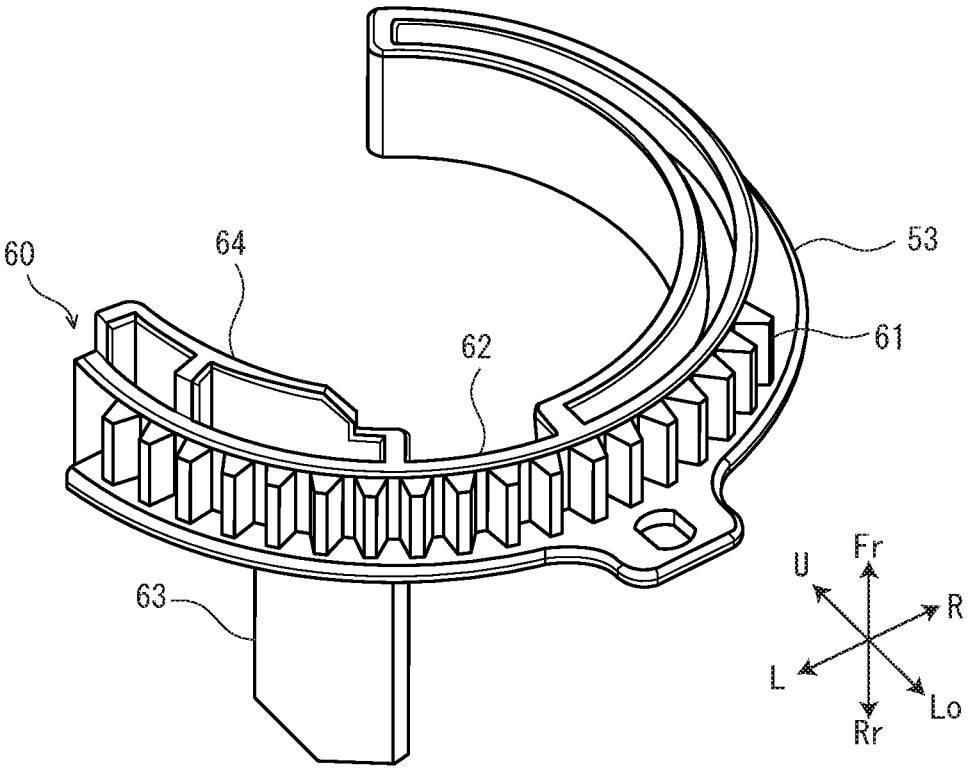
FIG. 21 is a perspective view showing the locking cam of the cover locking part as viewed from a front side in the tank cover of the printer according to the first embodiment of the present disclosure.
Figure 23:
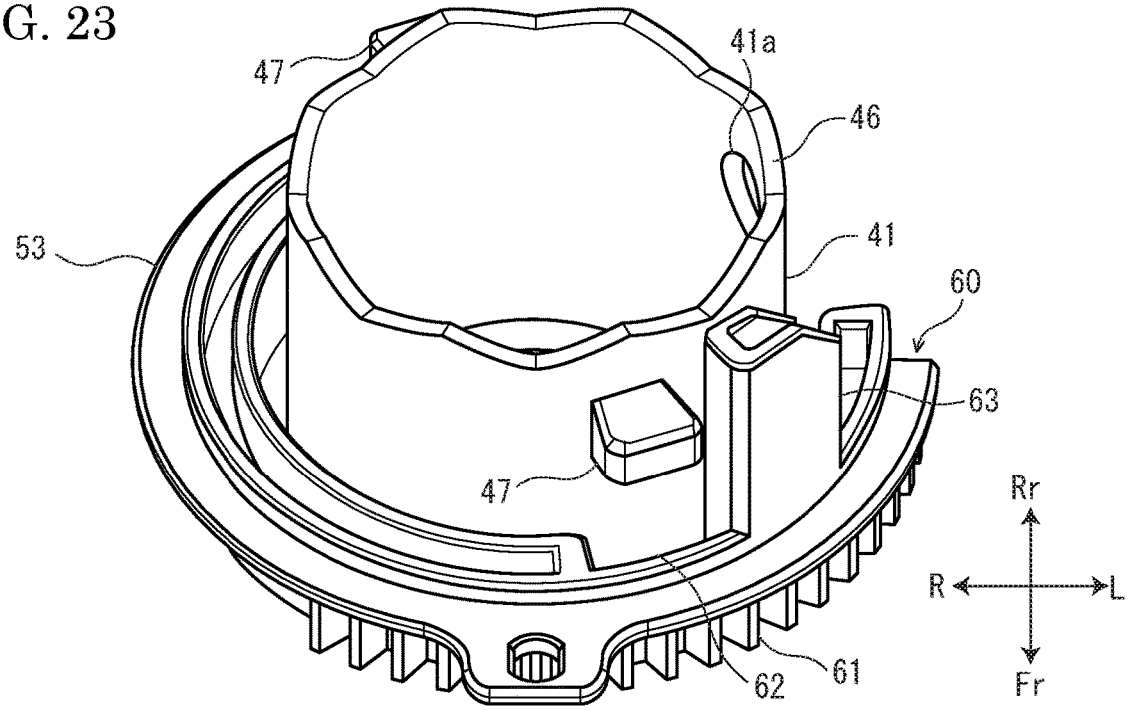
FIG. 23 is a perspective view showing the locking cam, in a condition incapable of rotating with respect to the pushing member, as viewed from the rear side in the tank cover of the printer according to the first embodiment of the present disclosure.

When the pushing member 41 in the nozzle retracting state is pushed, as shown in FIG. 19A, the pushing member 41 and the nozzle cam 42 are moved to the rear side, and then, the nozzle 21 is moved to a projecting position at the rear side. At this time, the nozzle 21 is inserted in the inflow port 18 of the waste ink tank 17 installed in the tank installed part 23. Moreover, since the nozzle cam 42 is rotated and the second protrusions 48 are engaged with the engaging gaps 35, regardless of pushing of the cam pushing spring 43, the nozzle cam 42 is restrained from moving to the front side. The pushing member 41 is pushed into the cylindrical wall 33 without receiving a force moving to the front side to indicate a projecting state of the nozzle 21. Thus, in a case where the pushing member 41 is in a nozzle projecting state, as shown in FIG. 23, the first protrusions 47 of the pushing member 41 are located at the rear side from the locking cam 53 of the cover locking part 50 described below.

When the pushing member 41 in the nozzle projecting state is pushed, the nozzle cam 42 is rotated and the second protrusions 48 are fitted in the slits 34 again, as shown in FIGS. 17A and 18A, the pushing member 41 and the nozzle cam 42 are pushed by the cam pushing spring 43 and moved to the front side, and the pushing member 41 becomes the nozzle retracting state. At this time, the nozzle 21 is moved to the front side, retracted from the inflow port 18 of the waste ink tank 17 installed in the tank installed part 23, and moved to the retracting position.

Components of the cover locking part 50 (the locking lever 51, the locking member 52 and the locking cam 53) will be described. Incidentally, the locking cam 53 is covered together with the components of the nozzle operating part 40 by the operating part cover 44 from the rear side. Moreover, the locking lever 51 and the locking member 52 may be covered by the operating part cover 44.

The locking lever 51 is formed as shown in FIGS. 13-16 so as to have a disk-shaped supporting part 54, a bar-shaped handle 55 and a flange 56, and arranged to be rotatable with respect to the locking operating hole 32 of the cover body 30.

The supporting part 54 has an outer diameter slightly smaller than an inner diameter of the locking operating hole 32 and is attached to be rotatable inside the locking operating hole 32. In a rear face of the supporting part 54, a columnar connected protrusion 57 connected to the locking member 52 is formed so as to be protruded to the rear side. The connected protrusion 57 is arranged below a center of the disk shape of the supporting part 54.

The handle 55 is formed on a front face of the supporting part 54 along a center line of the disk shape of the supporting part 54. The flange 56 is arranged in a rear end of an outer circumference face of the supporting part 54. On a part (e.g. an upper portion) of the outer circumference face of the supporting part 54, a gear 58 meshing with the locking cam 53 is formed.

The locking member 52 is formed in a plate shape elongated in the left and right directions and located at a lower side of the locking member 51. The locking member 52 is attached to the cover body 30 so as to be movable between a locking position at the right side and an unlocking position at the left side along the rear face of the cover body 30. In an upper portion of the locking member 52, an elliptic connecting hole 59 elongated in the upward and downward directions is provided and, to the connecting hole 59, the connected protrusion 57 of the supporting part 54 of the locking lever 51 is connected. When the locking lever 51 is rotated, the connected protrusion 57 is moved in the left and right directions, and accordingly, the locking member 52 having the connecting hole 59 connected to the connected protrusion 57 is moved in the left and right directions.

For example, in a case where the tank cover 22 is in the closing state, when the locking lever 51 is rotated in the counterclockwise direction, as shown in FIGS. 17B and 19B, the connected protrusion 57 is moved to the right side with respect to a center of the locking lever 51. According to this, the locking member 52 is moved to the locking position at the right side and inserted in the locking hole 25 of the supporting plate 24 of the tank installed part 23. Thereby, the cover locking part 50 becomes a locking state and the tank cover 22 in the closing state is locked to the printer body 2.

On the other hand, when the locking lever 51 is rotated in the clockwise direction, as shown in FIG. 18B, the connected protrusion 57 is moved to the left side with respect to the center of the locking lever 51. According to this, the locking member 52 is moved to the unlocking position at the left side and retracted from the locking hole 25. Thereby, the cover locking part 50 becomes an unlocking state and locking of the tank cover 22 to the printer body 2 is released.

Incidentally, the handle 55 of the locking lever 51 may be provided so as to become parallel to the left and right directions in a case where the cover locking part is in the locking state, and to become parallel to the upward and downward directions in a case where the cover locking part is in the unlocking state.

Moreover, out of an attaching mechanism of the locking member 52 to the cover body 2, a rotating mechanism of the locking lever 51 and a connecting mechanism of the connected protrusion 57 and the connecting hole 59, at least one mechanism may be configured so that movement of the locking member 52 is restricted between the locking position and the unlocking position.

The locking cam 53 is formed in an annular shape having a notch 60 in a part in a circumferential direction of the locking cam 53, i.e. a C-shape, as shown in FIGS. 14-16, 20, 21, 22 and 23. The locking cam 53 has an inner diameter slightly larger than an outer diameter of the cylindrical wall 33 of the cover body 30 and is rotatably fitted outside the cylindrical wall 33 along an outer circumference of the cylindrical wall 33.

In an outer circumference face of the locking cam 53, a gear 61 meshing with the gear 58 of the flange 56 of the locking lever 51 is formed. Thereby, the locking cam is rotated in an opposite direction to the locking lever 51 according to rotation of the locking lever 51. For example, in a case where the locking lever 51 is rotated in the counterclockwise direction to set the cover locking part 50 to the locking state (refer to FIGS. 17B and 19B), the locking cam 53 is rotated in the clockwise direction. On the other hand, in a case where the locking lever 51 is rotated in the clockwise direction to set the cover locking part 50 to the unlocking state (refer to FIG. 18B), the locking cam 53 is rotated in the counterclockwise direction.

In an inner circumference face of the locking cam 53, a recessed portion 62 is formed in a part (the lower side) in the circumferential direction, and the notch 60 and the recessed portion 62 are provided on a center line of the locking cam 53. The notch 60 and the recessed portion 62 compose a push allowing part allowing pushing operation of the pushing member 41 of the nozzle operating part 40. When the cover locking part 50 is set to the locking state (refer to FIGS. 17B and 19B), the notch 60 and the recessed portion 62 of the locking cam 53 rotated in the clockwise direction are located at the same positions as the upper and lower slits 34 of the cylindrical wall 33 of the cover body 30 in the circumferential direction, as shown in FIG. 23. Therefore, since the first protrusions 47 of the pushing member 41 become movable through the slits 34 and the notch 60 and the recessed portion 62 in the forward and backward directions, movement of the pushing member 41 in the forward and backward directions is allowed, that is, pushing operation of the pushing member 41 is allowed.

In a rear face of the locking cam 53, at an upstream side just before the recessed portion 62 in the counterclockwise direction, a rotation restricting part 63 protruded to the rear side is provided at the lower side on the rear face. As described above, when the cover locking part 50 is set to the locking state, the push allowing part composed of the notch 60 and the recessed portion 62 of the locking cam 53 allows pushing operation of the pushing member 41, and thereby, the pushing member 41 can be pushed into the cylindrical wall 33 and set to the nozzle projecting state. At this time, as shown in FIG. 23, the first protrusions 47 of the pushing member 41 are located at the rear side from the locking cam 53, particularly, the lower first protrusion 47 is located at the downstream side just before the rotation restricting part 63 in the counterclockwise direction. Therefore, rotation in the counterclockwise direction of the locking cam 53 is restricted by contact of the rotation restricting part 63 to the first protrusions 47. That is, it is restricted that the locking lever 51 is rotated in the counterclockwise direction and the cover locking part 50 is set to the unlocking state.

Incidentally, when the pushing member 41 is set to the nozzle retracting state protruded to the front side from the front face of the cover body 30, the first protrusions 47 of the pushing member 41 are located at the front side from the locking cam 53. Therefore, even if the locking cam 53 is rotated, because the rotation restricting part 63 does not come into contact with the first protrusions 47, the locking cam 53 can be rotated in the counterclockwise direction. That is, the locking lever 51 can be rotated in the clockwise direction and the cover locking part 50 can be set to the unlocking state.

In other words, when the cover locking part 50 is in the locking state, in a case where the pushing member 41 is in the nozzle projecting state, the cover locking part 50 cannot be set to the unlocking state, but, in a case where the pushing member 41 is in the nozzle retracting state, the cover locking part 50 can be set to the unlocking state.

Moreover, in a front face of the locking cam 53, at an upstream side just before the recessed portion 62 in the counterclockwise direction, a push restricting part 64 is provided at the lower side of the front face along the outer circumference face of the cylindrical wall 33 of the cover body 30. As described above, if the pushing member 41 is not set to the nozzle retracting state, the cover locking part 50 cannot be set to the unlocking state. When the cover locking part 50 is set to the unlocking state (refer to FIG. 18B), the push restricting part 64 of the locking cam 53 rotated in the counterclockwise direction is located at the same position as the lower first protrusion 47 of the pushing member 41 in the circumferential direction, as shown in FIG. 22. At this time, since the first protrusions 47 are located at the front side from the push restricting part 64 of the locking cam 53, movement of the pushing member 41 to the rear side is restricted by contact of the first protrusions 47 to the push restricting part 64, that is, pushing operation of the pushing member 41 is restricted. In other words, when the cover locking part 50 is in the unlocking state, the pushing member 41 cannot be switched from the nozzle retracting state to the nozzle projecting state.

In accordance with the embodiment, as described above, the waste ink conveying device 1*a* of the printer 1 includes the waste ink tank 17 installed in the tank installed part 23 to contain the waste ink, and the tank cover 22 opening/closing the tank installed part 23. The waste ink tank 17 includes the inflow port 18 in which the waste ink is flowed from a side of the tank cover 22 in the closing state. The tank cover 22 includes the nozzle 21 being inserted in the inflow port 18 to flow the waste ink in the waste ink tank 17 when the tank cover 22 is in the closing state, the nozzle operation part 40 switching projecting and retracting of the nozzle 21 in order to insert and retract the nozzle 21 with respect to the inflow port 18, and the cover locking part 50 switching locking and unlocking of the closing state of the tank cover 22. Subsequently, the waste ink conveying device 1*a* makes the cover locking part 50 capable of switching to the unlocking state in a case where the cover locking part 50 is in the locking state and the nozzle 21 is in the retracting state. On the other hand, the waste ink conveying device 1*a* makes the cover locking part 50 incapable of switching to the unlocking state in a case where the cover locking part 50 is in the locking state and the nozzle 21 is in the projecting state.

Concretely, the nozzle operating part 40 includes the pushing member 41 as the nozzle supporting part moving between one side (the front side) where the nozzle 21 is set to the retracting state and the other side (the rear side) where the nozzle 21 is set to the projecting state. The cover locking part 50 includes the locking cam 53 rotating around the pushing member 41. The pushing member includes the first protrusion 47 (the protrusion) located at one side from the locking cam 53 in a case where the pushing member 41 is located at one side, but located at the other side from the locking cam 53 in a case where the pushing member 41 is located at the other side. The locking cam 53 is rotated in one direction (the clockwise direction as viewed from the front side) in a case where the cover locking part 50 is switched to the locking state, but rotated in the other direction (the counterclockwise direction as viewed from the front side) in a case where the cover locking part 50 is switched to the unlocking state. The locking cam 53 includes the rotation restricting part 63 protruded to the other side at the downstream side in the other direction from the first protrusion 47.

Accordingly, in a case where the nozzle 21 is in the projecting state being inserted in the waste ink tank 17, since the tank cover 22 cannot be opened, it is restrain scattering of the waste ink from the nozzle 21 and the inflow port 21 of the waste ink tank 17. By providing the locking cam 53, it is possible to interlock the nozzle operating part 40 and the cover locking part 50. Moreover, since the nozzle 21 and the inflow port 18 are not bonded, opening/closing of the tank cover 22 does not break the nozzle 21 and the inflow port 18, and it is possible to restrain leakage of the waste ink, malfunctions of installing of the nozzle 21 and the inflow port 18, clogging of the waste ink in the nozzle 21 and the tube 20 due to breakage of the nozzle 21 and the tube 20. Incidentally, since it is unnecessary to put the cap 19 into an attached state for inserting and retracting of the nozzle 21, the cap 19 is not broken and the inflow port 18 can be surely sealed by the cap 19 when the waste ink tank 17 is replaced. Therefore, it is possible to restrain waste ink contamination and malfunction due to replacement of the waste ink tank 17.

Moreover, in the first embodiment, the waste ink conveying device 1*a* of the printer 1 having such a configuration as described above makes the nozzle 21 incapable of switching to the projecting state in a case where the cover locking part 50 is in the unlocking state and the nozzle 21 is in the retracting state.

Concretely, the locking cam 53 of the cover locking part 50 includes the recessed part 62 located at the same position as the first protrusion 47 in the circumferential direction in a case where the locking cam 53 is rotated in one direction, and the push restricting part 64 located at the same position as the first protrusion 47 in the circumferential direction in a case where the locking cam 53 is rotated in the other direction.

Thereby, in a condition that the tank cover 22 is opened, since the nozzle 21 cannot be set to the projecting state, it is possible to restrain misoperation of the nozzle 21 and restrain waste ink contamination due to contact to the projected nozzle 21.

Incidentally, structure of the nozzle operating part 40 is not limited by an example described about the tank cover 22 of the waste ink conveying device 1*a* according to the above-described first embodiment. Next, the tank cover 22 of the waste ink conveying device 1*a* according to a second embodiment will be described with reference to FIGS. 24-34.

Figure 24:
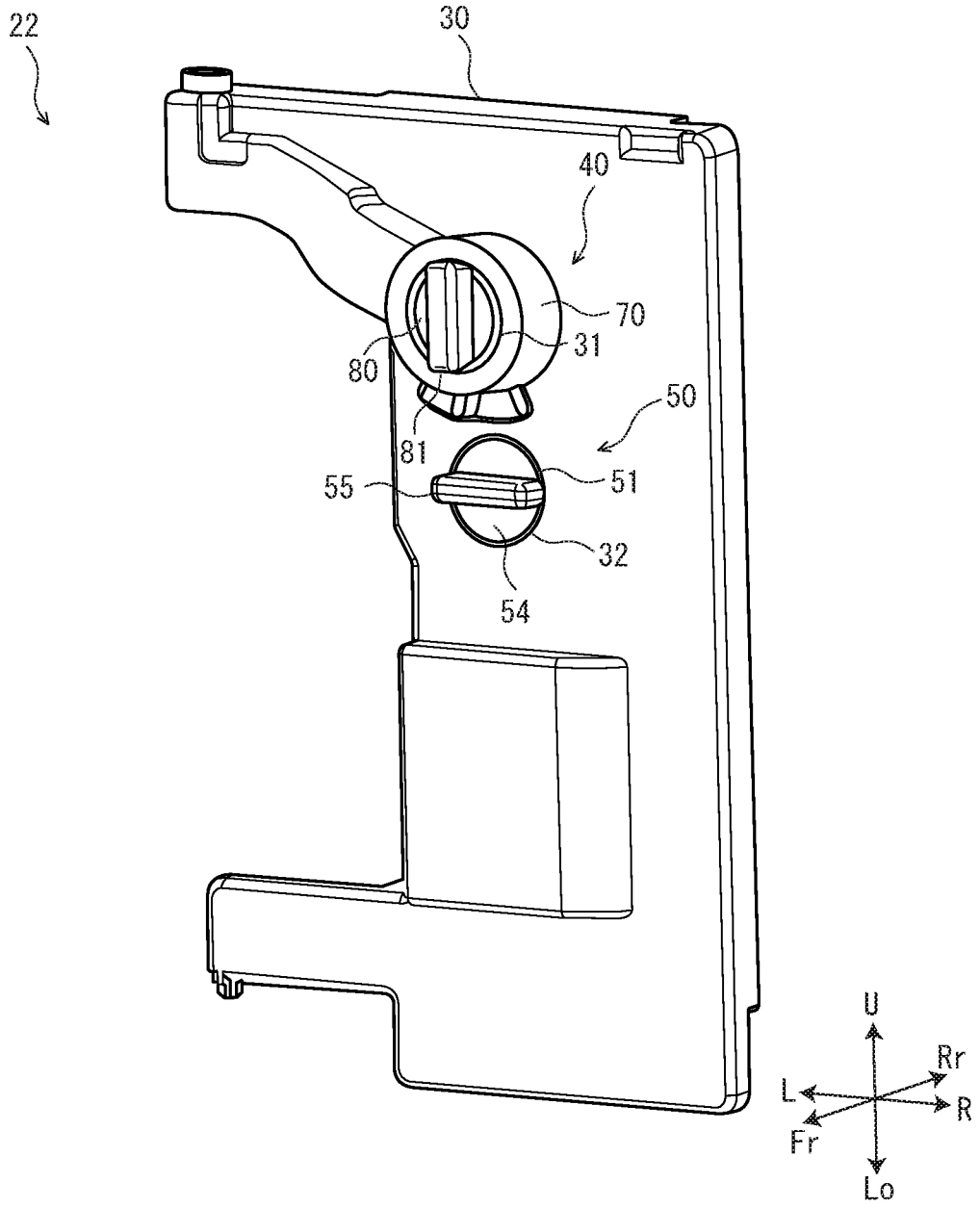
FIG. 24 is a perspective view showing the tank cover as viewed from the front side in the printer according to a second embodiment of the present disclosure.
Figure 25:
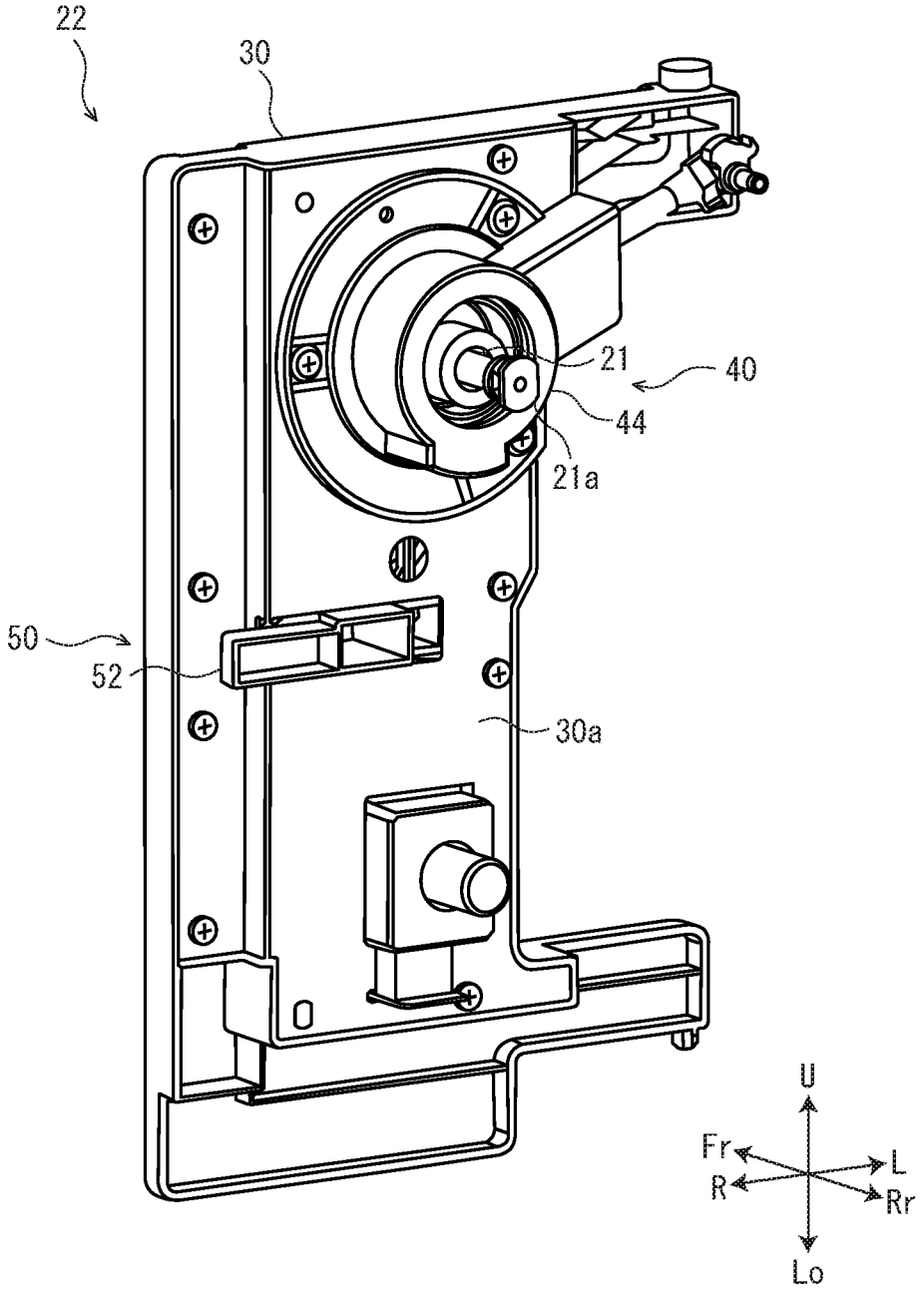
FIG. 25 is a perspective view showing the tank cover as viewed from the rear side in the printer according to the second embodiment of the present disclosure.
Figure 26:
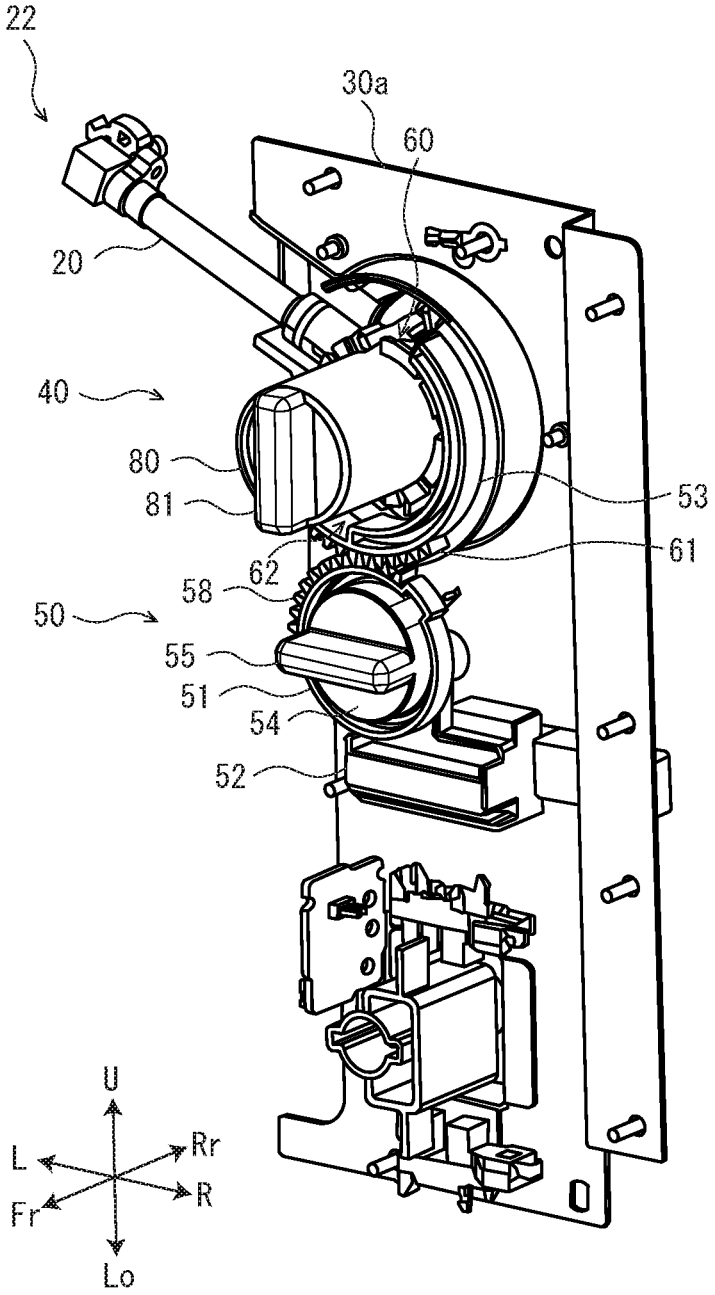
FIG. 26 is a perspective view showing the tank cover, in a condition that the cover body is removed, as viewed from the front side in the printer according to the second embodiment of the present disclosure.
Figure 27:
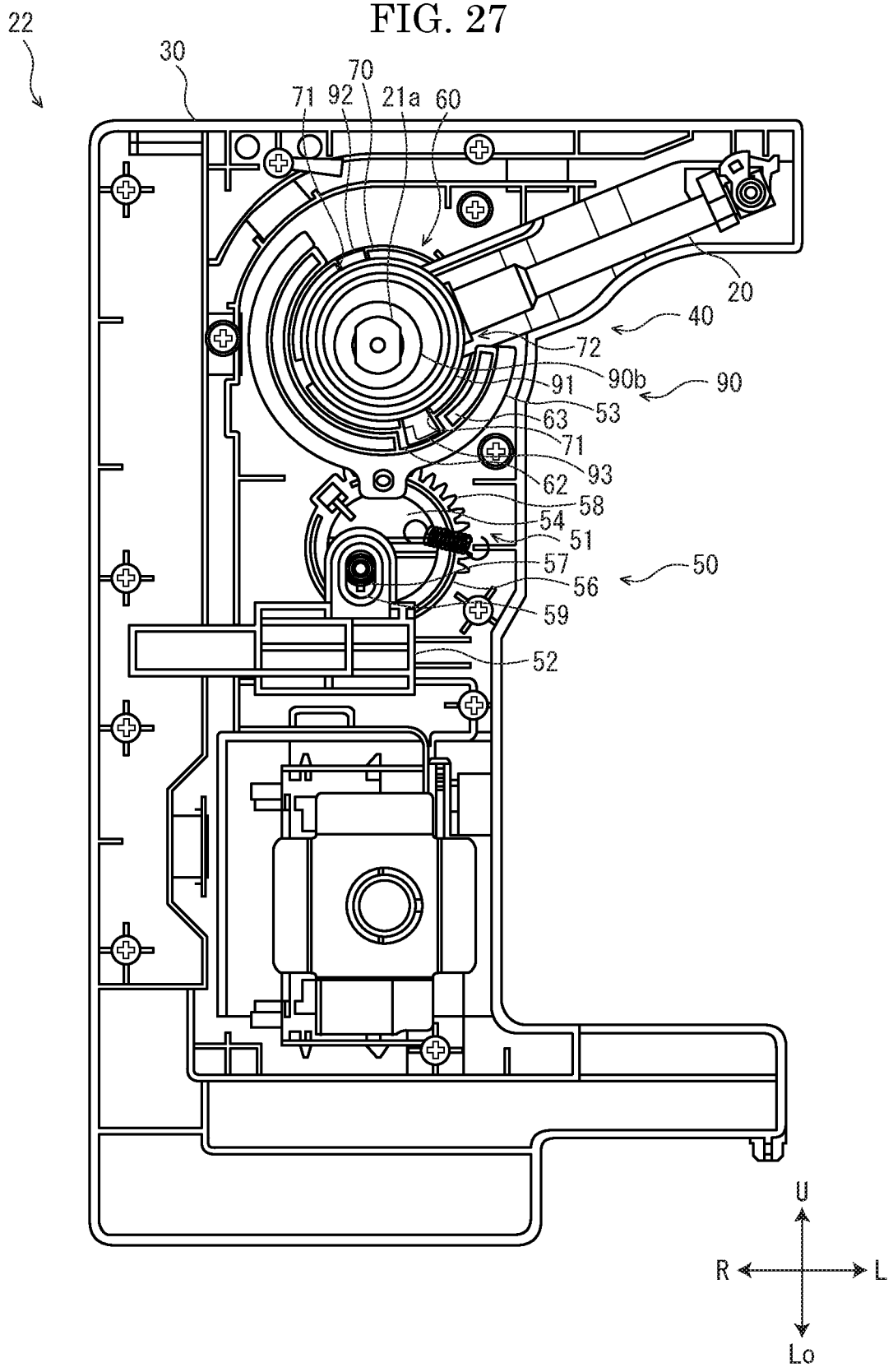
FIG. 27 is a rear view showing the tank cover, in a condition that an operating part cover and an inside cover are removed, in the printer according to the second embodiment of the present disclosure.
Figure 28:
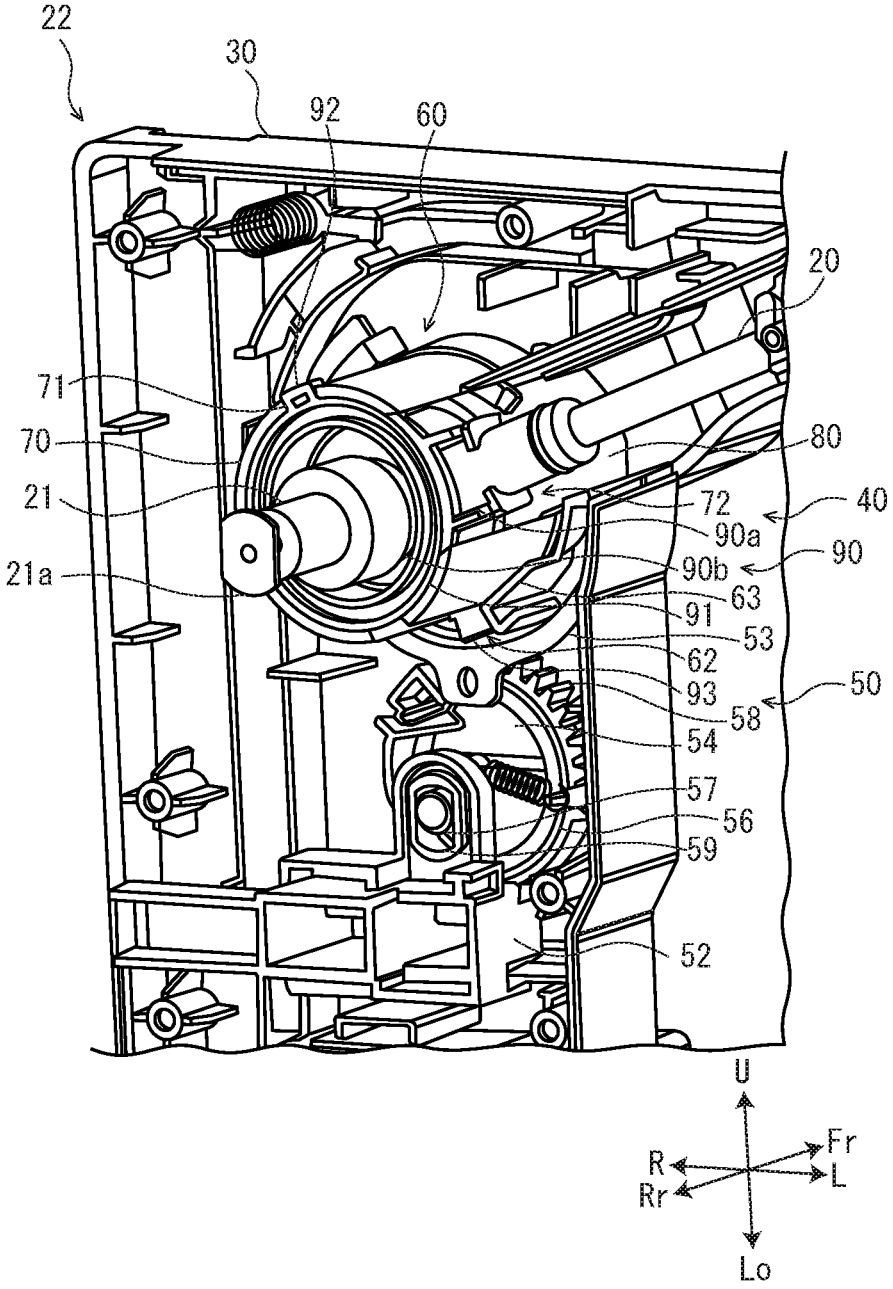
FIG. 28 is a perspective view showing the tank cover, in a condition that the operating part cover and the inside cover are removed, as viewed from the rear side in the printer according to the second embodiment of the present disclosure.
Figure 29:
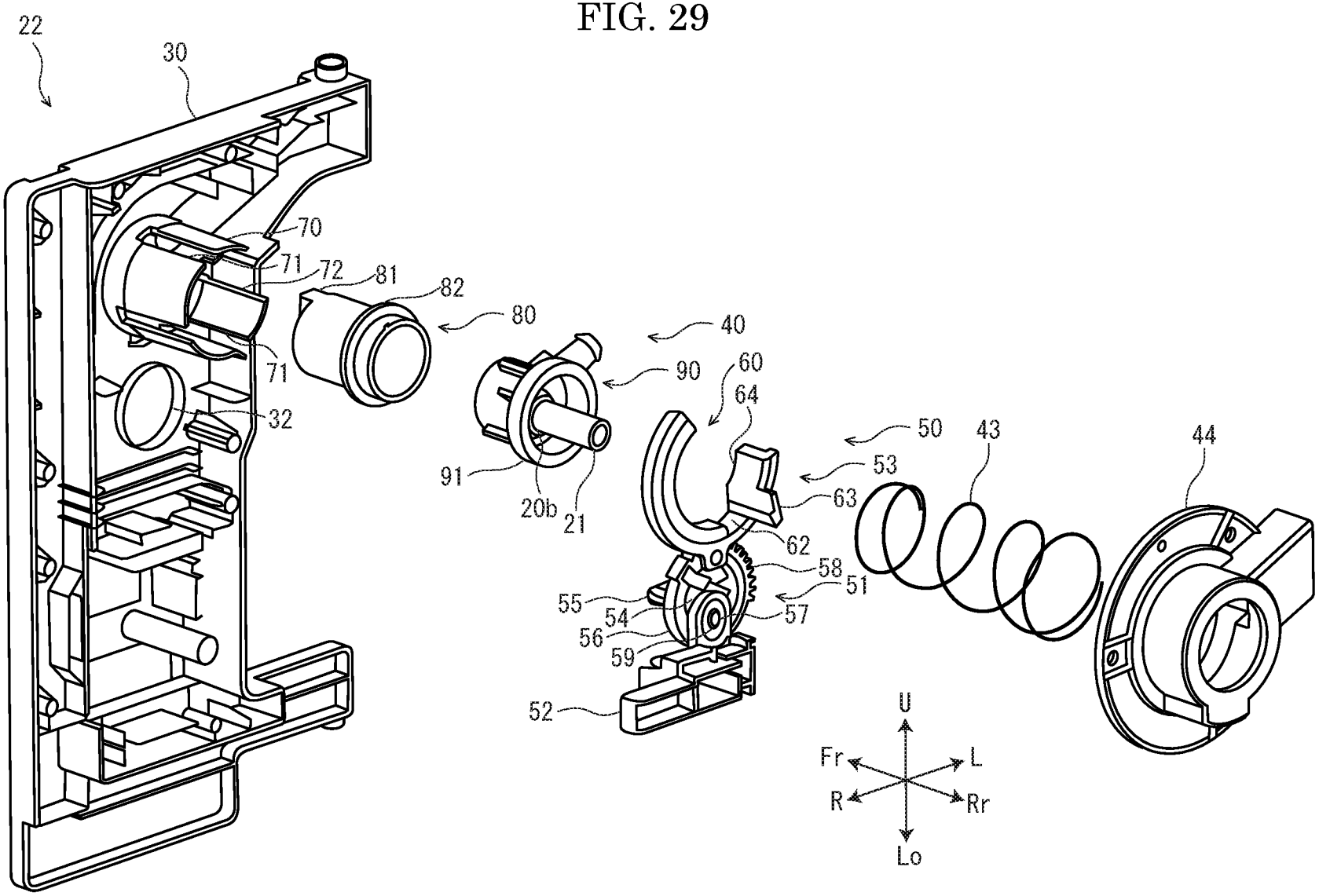
FIG. 29 is an exploded perspective view showing the tank cover, in a condition that the cover body is removed, as viewed from the rear side in the printer according to the second embodiment of the present disclosure.
Figure 30:
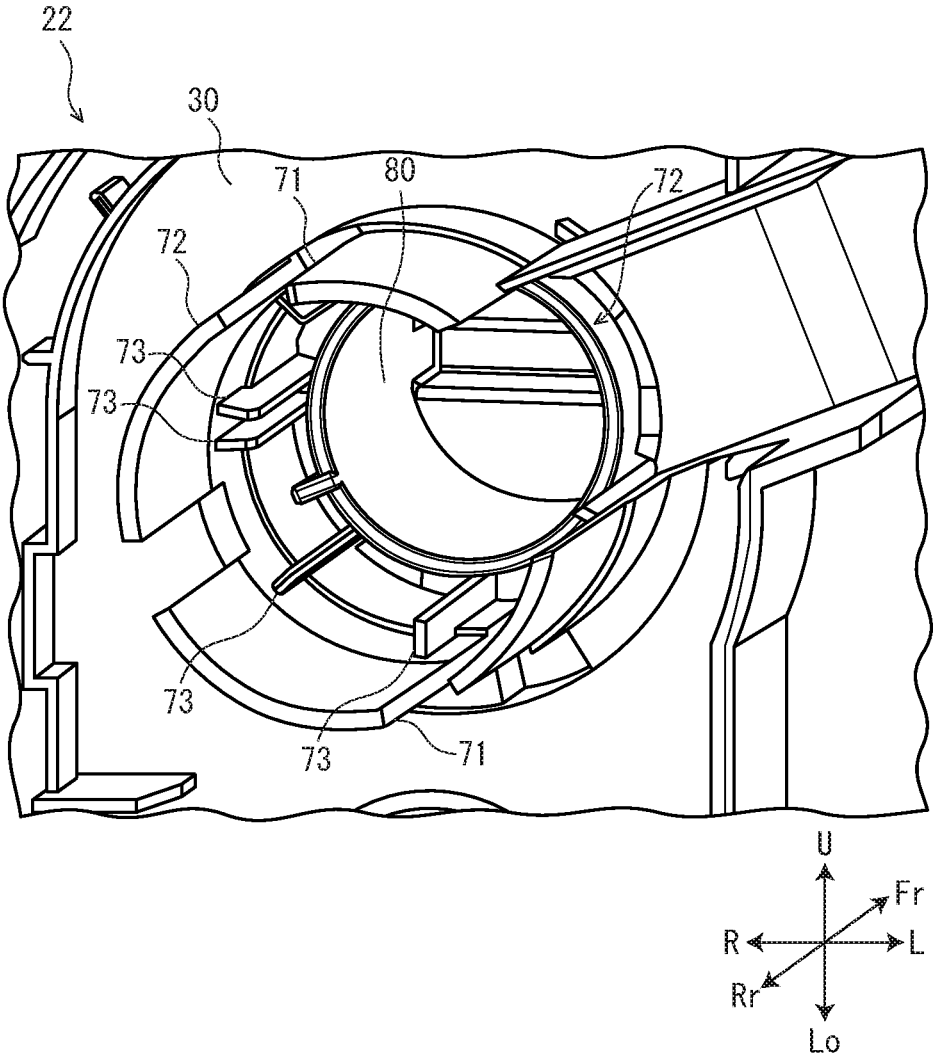
FIG. 30 is a perspective view showing a cylindrical wall and the periphery as viewed from the rear side in the tank cover of the printer according to the second embodiment of the present disclosure.
Figure 31:
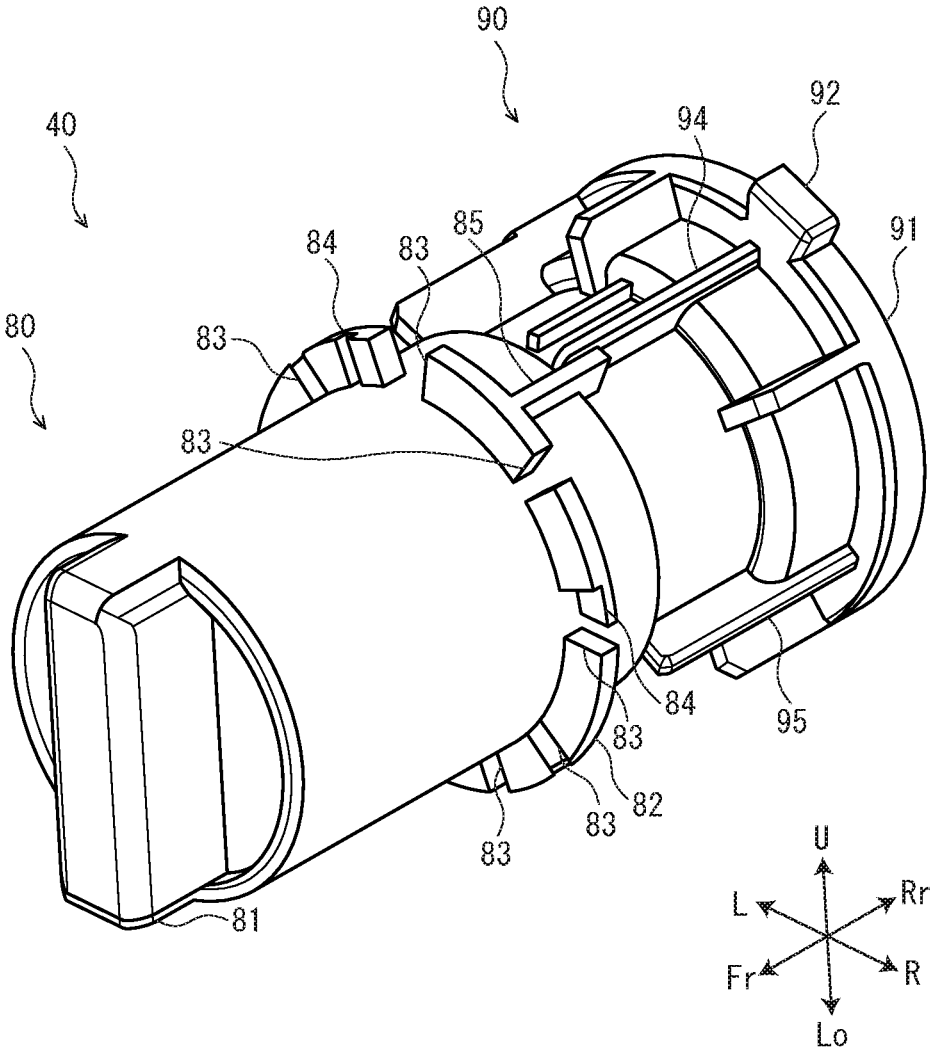
FIG. 31 is a perspective view showing the pushing member and a nozzle cam as viewed from the front side in the tank cover of the printer according to the second embodiment of the present disclosure.
Figure 32:
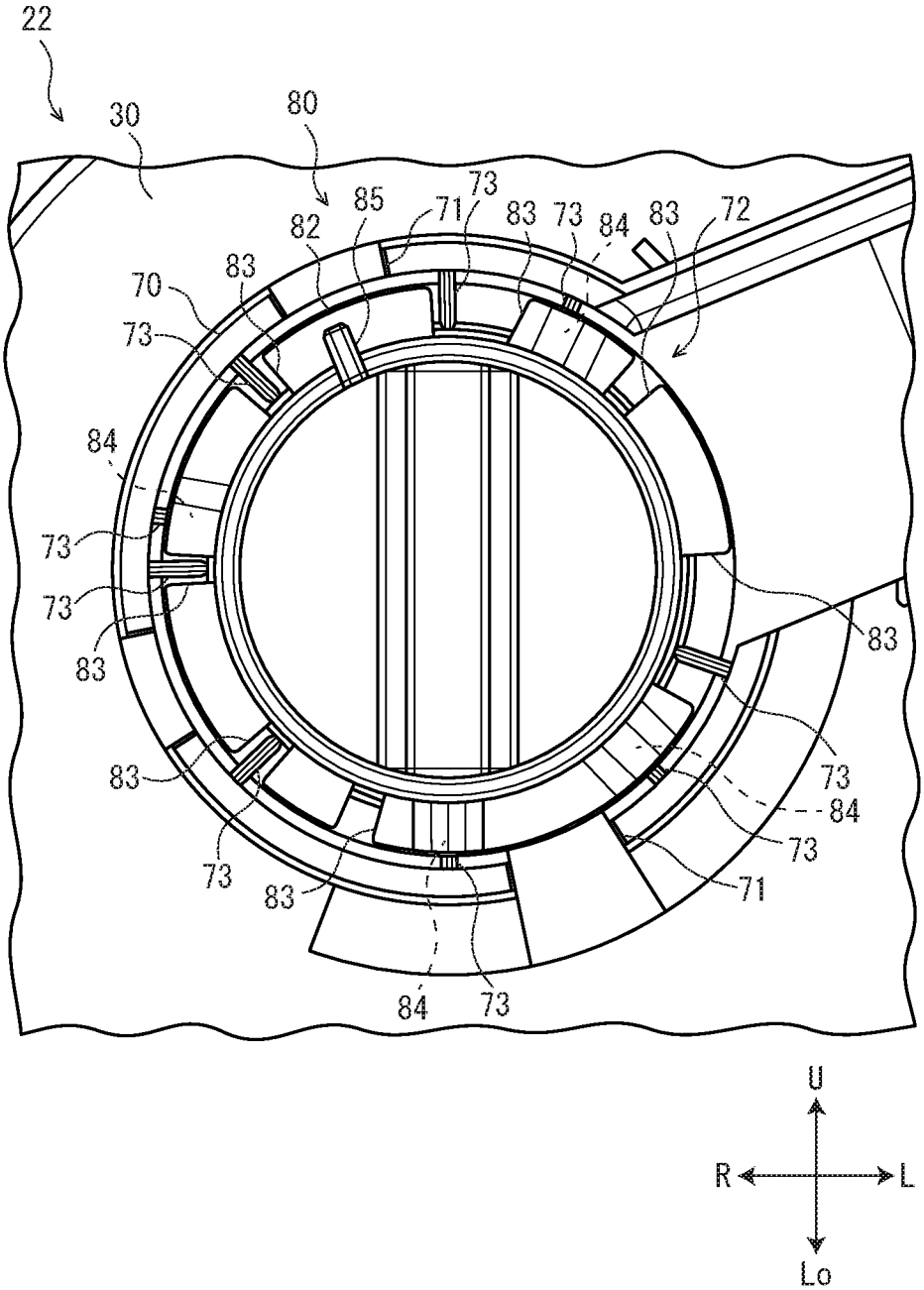
FIG. 32 is a rear view showing the pushing member to the cylindrical wall, in a condition that the nozzle is set to the projecting state, in the tank cover of the printer according to the second embodiment of the present disclosure.
Figure 33:
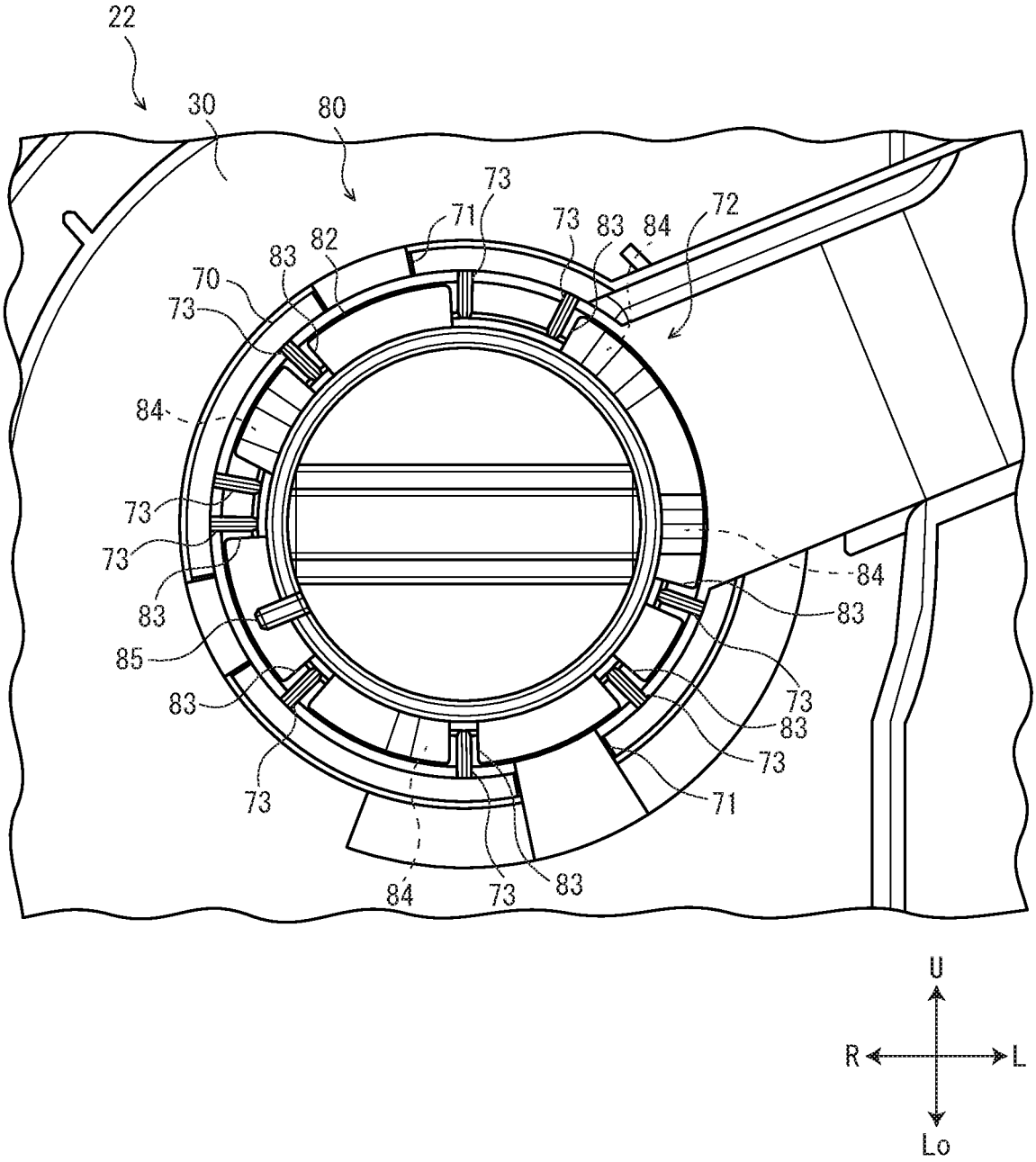
FIG. 33 is a rear view showing the pushing member to the cylindrical wall, in a condition that the nozzle is set to the retracting state, in the tank cover of the printer according to the second embodiment of the present disclosure.
Figure 34:
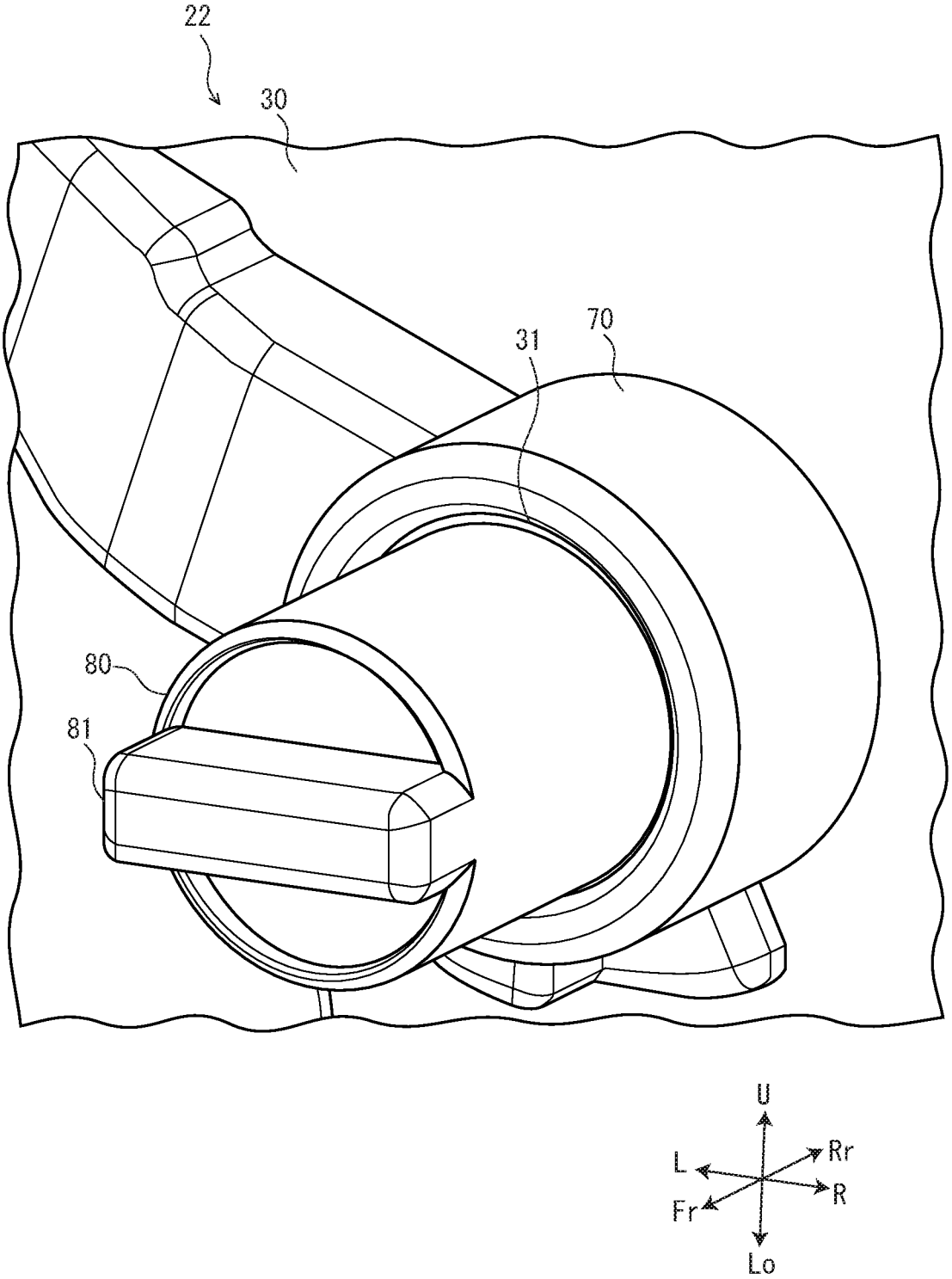
FIG. 34 is a perspective view showing the pushing member projected to the front side from the cylindrical wall and the periphery as viewed from the front side in the tank cover of the printer according to the second embodiment of the present disclosure.

FIG. 24 is a front perspective view of the tank cover 22 and FIG. 25 is a rear perspective view of the tank cover 22. FIG. 26 is a front perspective view of the tank cover 22 in a condition that the cover body 30 is removed, and FIGS. 27 and 28 are a rear view and a rear perspective view of the tank cover 22 in a condition that the operating part cover 44 of the nozzle operating part 40 and an inside cover 30 of the cover body 30 are removed. FIG. 29 is an exploded rear perspective view of the tank cover 22 in a condition that the cover body 30. FIG. 30 is a rear perspective view of a cylindrical wall 70 and the periphery of the cover body 30. FIG. 31 is a front perspective view of a pushing member 80 and a nozzle cam 90 of the nozzle operating part 40. FIG. 32 is a rear view of the pushing member 80 to the cylindrical wall 70 in a condition that the pushing member 80 is pushed into the cylindrical wall 70 and the nozzle 21 is set to the projecting state, and FIG. 33 is a rear view of the pushing member 80 to the cylindrical wall 70 in a condition that the pushing member 80 is protruded to the front side from the cylindrical wall 70 and the nozzle 21 is set to the retracting state. FIG. 34 is a front perspective view of the pushing member 80 projected to the front side from the cylindrical wall 70 and the periphery.

The tank cover 22 of the second embodiment has almost the same configuration as the first embodiment. Thereupon, hereinafter, the different structure from the first embodiment will be mainly described and description of the same structure as the first embodiment is omitted. The tank cover 22 of the second embodiment includes the nozzle 21, the nozzle operating part 40 and the cover locking part 50 similar to the first embodiment, the cover body 30, as shown in FIGS. 24, 25, 26, 27, 28 and 29, but the nozzle operating part 40 and the cover locking part 50 have the different structure from the first embodiment.

For example, in the second embodiment, the cover body 30 includes the cylindrical wall 70 corresponding to the cylindrical wall 33 of the first embodiment, and the nozzle operating part 40 includes the pushing member 80 and the nozzle cam 90 corresponding to the pushing member and the nozzle cam 42 of the first embodiment. Incidentally, the nozzle 21, the nozzle operating part 40 and the cover locking part 50 are provided at the rear side of the cover main body 30 mainly and, shown in FIGS. 25 and 26, covered by the inside cover 30*a* attached to the rear side of the cover body 30 and protected by the inside cover 30*a*.

The cylindrical wall 70 of the cover body 30 has an inner diameter larger than the nozzle operating hole 31 as shown in FIGS. 27, 28, 29 and 30 and is erected to the rear side from the circumference over the nozzle operating hole 31. Incidentally, although FIGS. 24 and 34 illustrate an example that the cylindrical wall 70 is formed so as to penetrate the cover body 30 in the forward and backward directions and an annular bottom face having the nozzle operating hole 31 is formed at a front end of the cylindrical wall 70, the cylindrical wall 70 is not limited by this example. In another example, the cylindrical wall 70 may be formed so as to be extended to the rear side from the rear face of the cover body 30 having the nozzle operating hole 31 and, in this case, a part (a circumferential portion over the nozzle operating hole 31) of the cover body 30 constitutes the bottom at the front end of the cylindrical wall 70.

In a rear part of the cylindrical wall 70, two slits 71 extended from a rear end of the cylindrical wall 70 to the front end are formed at the upper side and the lower side, and each slit 71 is cut out just before a rear end of the cover body 30. At the left side in the cylindrical wall 70, an opening 72 in which the proximal end of the nozzle 21 is located is provided and the proximal end of the nozzle 21 can be moved in the forward and backward direction inside the opening 72. Incidentally, FIGS. 25, 27 and 28 illustrate a stopper 21*a* at the distal end of the nozzle 21, but, in FIG. 29, the stopper 21*a* is omitted from the nozzle 21.

On an inner circumference face of the cylindrical wall 70, as shown in FIGS. 30, 32 and 33, a plurality of ribs 73 are provided at intervals in the circumferential direction. Each rib 73 is formed from the inner circumference face of the cylindrical wall 70 to the edge of the nozzle operating hole 31 in a radial direction, in other words, an inner diameter composed of the plurality of ribs 73 is equal to the inner diameter of the nozzle operating hole 31. In addition, each rib 73 is formed so as to be extended backwardly from a front face of the cylindrical wall 70 to the vicinity of a center of the cylindrical wall 70 in the forward and backward directions.

The pushing member 80 of the nozzle operating part is formed in a cylindrical shape shorter than the cylindrical wall 70 in the forward and backward directions, as shown in FIGS. 29, 31 and 34. The pushing member 80 has an outer diameter slightly smaller than the inner diameter of the nozzle operating hole 31 of the cover body 30 and the inner diameter composed of the plurality of ribs 73 of the cylindrical wall 70, is fitted in the nozzle operating hole 31 and the cylindrical wall 70, and can be moved along the plurality of ribs 73 in the forward and backward directions. Incidentally, the pushing member 80 is pushed to the front side by the nozzle cam 90 biased to the front side with the cam pushing spring 43, as described below.

Moreover, the pushing member 80 is rotatable in the clockwise direction and the counterclockwise direction as viewed from the front side around a rotation axis extended in the forward and backward directions inside the nozzle operating hole 31 and the cylindrical wall 70. The pushing member 80 is rotated according to operation of a user. For example, in an activation condition of the printer 1, as shown in FIGS. 24, 26 and 32, the pushing member 80 is rotated to a predetermined activation position at a side in the counterclockwise direction. But, in a non-activation condition of the printer 1, as shown in FIGS. 33 and 34, the pushing member 80 is rotated to a predetermined non-activation position at a side in the clockwise direction.

In a front end of the cylindrical pushing member 80, a bottom face (a front face) having an operation lever protruded to the front side is provided and the operation lever 81 is formed along a center line of a circle shape of the bottom face of the pushing member 80. Incidentally, the operation lever 81 may be provided so as to become parallel to the upward and downward directions in a case where the pushing member 80 is in the activation position, and to become parallel to the left and right directions in a case where the pushing member 80 is in the non-activation position.

On an outer circumference face of a rear part of the pushing member 80, a flange 82 is provided and the flange 82 is formed to have an outer diameter larger than the inner diameter composed of the plurality of ribs 73 of the cylindrical wall 70 and slightly smaller than an inner diameter of the cylindrical wall 70. The flange 82 has a plurality of flange gaps 83 and a plurality of locking recessed portions 84. Moreover, on an outer circumference face of a rear end of the pushing member 80, a restricted rib 85 is provided at the rear side from the flange 82.

The plurality of flange gaps 83 are arranged at the same intervals as the plurality of ribs 73 of the cylindrical wall 70 in the circumferential direction. When the flange 82 is located at the rear side from the plurality of ribs 73 in a condition that the pushing member 80 is located inside the cylindrical wall 70, the pushing member 80 becomes rotatable because each rib 73 is not interfered with each flange gap 83.

When the pushing member 80 is located at the non-activation position, all of the plurality of flange gaps 83 are respectively located so as to correspond to the plurality of ribs 73 (located at the same positions as the plurality of ribs 73 in the circumferential direction) and the pushing member 80 becomes movable to the front side. At this time, the pushing member 80 is moved to the front side by receiving biasing force of the cam pushing spring 43 and each rib 73 is fitted in each flange gap 83, and the pushing member 80 is moved to the front side along the nozzle operating hole 31 and the plurality of ribs 73 until the flange 82 comes into contact with the bottom face of the cylindrical wall 70.

Incidentally, the pushing member 80 at the non-activation position is restricted from rotating by fitting of each rib 73 and each flange gap 83. When the pushing member 80 at the non-activation position is pushed to the rear side against the biasing force of the cam pushing spring 43, since the flange 82 is located at the rear side from the plurality of ribs 73, and fitting of each rib 73 and each flange gap 83 is released, the pushing member 80 becomes rotatable.

The plurality of locking recessed portions 84 are provided at intervals in the circumferential direction and recessed in a front face of the flange 82. When the pushing member 80 is located at the activation position, each locking recessed portion 84 is located so as to correspond to any one of the plurality of ribs 73 (located at the same position as any one of the ribs 73 in the circumferential direction). At this time, the pushing member 80 receives the biasing force of the cam pushing spring 43, but any one of the ribs 73 is fitted in each locking recessed portion 84 and locked, and thereby, the pushing member 80 is restricted from moving to the front side.

Incidentally, the pushing member 80 at the activation position is restricted from rotating because any one of the ribs 73 is fitted in each locking recessed portion 84 and the other rib 73 is fitted in the flange gap 83. When the pushing member 80 at the activation position is pushed to the rear side against the biasing force of the cam pushing spring 43, since the flange 82 is located at the rear side from the plurality of ribs 73, and fitting of the rib 73 and the locking recessed portion 84 or the flange gap 83 is released, the pushing member 80 becomes rotatable.

The restricted rib 85 is locked by a first restricting rib 94 of the nozzle cam 90 as described below when the pushing member 80 is rotated to the activation position in the counterclockwise direction, and then, restricts rotation over the activation position of the pushing member 80. Moreover, the restricted rib 85 is locked by a second restricting rib 95 of the nozzle cam 90 as described below when the pushing member 80 is rotated to the non-activation position in the clockwise direction, and then, restricts rotation over the non-activation position of the pushing member 80.

The nozzle cam 90 of the nozzle operating part 40 is the nozzle supporting part, instead of the pushing member 41 of the first embodiment, moving between one side (the front side) where the nozzle 21 is set to the retracting state and the other side (the rear side) where the nozzle 21 is set to the projecting state. The nozzle cam 90 includes a lower protrusion 93 (the protrusion) located at one side from the locking cam 53 in a case where the nozzle cam 90 is located at one side, but located at the other side from the locking cam 53 in a case where the nozzle cam 90 is located at the other side.

The nozzle cam 90 is formed in a cylindrical shape shorter than the cylindrical wall 70 in the forward and backward directions, as shown in FIGS. 29 and 31. The nozzle cam 90 is fitted in the cylindrical wall 70 at the rear side from the pushing member 80 and provided movable in the forward and backward directions. The nozzle cam 90 may have ribs on an outer circumference face thereof in order to reduce sliding resistance to 70 inner circumference face of the cylindrical wall 70 and to restrain rotation. On an outer circumference face of a rear end of the nozzle cam 90, a flange 91 is provided, and the flange 91 is formed to have an outer diameter lager than the inner diameter composed of the plurality of ribs 73 of the cylindrical wall 70 and slightly smaller than the inner diameter of the cylindrical wall 70.

When the flange 91 is locked by rear ends of the plurality of ribs 73, the nozzle cam 90 is restricted from moving to the front side.

A front end of the nozzle cam 90 has an outer diameter slightly smaller than an inner diameter of the pushing member 80 and is fitted in a rear end of the pushing member 80. Thereby, the pushing member 80 is connected to the nozzle cam 90 and becomes rotatable with respect to the nozzle cam 90. The pushing member 80 and the nozzle cam 90 in a mutually connected state are fitted in the cylindrical wall 70.

In the second embodiment, the nozzle cam 90 is the nozzle supporting part supporting the nozzle 21, a nozzle hole 90*a* allowing for insertion of the proximal end of the nozzle 21 is formed in a left face of the nozzle cam 90, and a nozzle hole 90*b* allowing for insertion of the distal end of the nozzle 21 is formed in a center of a rear face of the nozzle cam 90. Moreover, in the rear face of the nozzle cam 90, a supporting groove supporting the front end of the cam pushing spring 43 is formed around the nozzle hole 90*b*, and the nozzle cam 90 is biased to the front side by the cam pushing spring 43 as described below.

Incidentally, the nozzle 21 is inserted in the nozzle hole 90*a* and the nozzle hole 90*b* of the nozzle cam 90 by using the L-shape of the nozzle 21, and thereby, supported by the nozzle cam 90. Since the nozzle 21 is positioned in the forward and backward directions by the nozzle hole 90*a* of the nozzle cam 90, the nozzle 21 is moved in the forward and backward directions as the nozzle cam 90 is moved in the forward and backward directions.

In the second embodiment, the nozzle operating hole 31 and the cylindrical wall 70 of the cover body 30 is configured so that, in a case where the tank cover 22 is in the closing state, a position of the nozzle hole 90*b* of the nozzle cam 90 corresponds to a position of the inflow port 18 of the waste ink tank 17 installed in the tank installed part 23.

The nozzle cam 90 includes an upper protrusion 92 and the lower protrusion 93 (the protrusion), as shown in FIG. 28. The upper protrusion 92 is formed so as to be protruded from the upper side of a rear end of an outer circumference face of the nozzle cam 90 in the outward radial direction, and the lower protrusion 93 is formed so as to be protruded from the lower side of the flange 91 of the nozzle cam 90 in the outward radial direction. Moreover, on the outer circumference face of the nozzle cam 90, the first restricting rib 94 and the second restricting rib 95 protruded in the outward radial direction are provided.

The upper protrusion 92 and the lower protrusion 93 have dimensions capable of fitting in the upper and lower slits 71 of the cylindrical wall 70. The nozzle cam 90 is fitted in the cylindrical wall 70 in a condition that the upper protrusion 92 and the lower protrusion 93 are fitted in the upper and lower slits 71, and become movable along the cylindrical wall 70 in the forward and backward directions. By fitting the upper protrusion 92 and the lower protrusion 93 into the respective slits 71, the nozzle cam 90 is restricted from rotating. Incidentally, the upper protrusion 92 and the lower protrusion 93 may be protruded outside an outer circumference face of the cylindrical wall 70 in the outward radial direction.

The first restricting rib 94 and the second restricting rib 95 are provided at intervals (e.g. an interval of 90 degrees) in the circumferential direction, and lock the restricted rib 85 of the pushing member 80 to restrict rotation of the pushing member 80.

The pushing member 80 and the nozzle cam 90 in a condition fitted in the cylindrical wall 70 are covered together with the cylindrical wall 70 by the operating part cover 44 from the rear side. Between the nozzle cam 90 and the operating part cover 44, the cam pushing spring 43 is arranged, and the nozzle cam 90 is biased to the front side by the cam pushing spring 43. Thereby, the nozzle cam 90 is restricted from displacing to the rear side from the cylindrical wall 70.

Inserting and retracting operation of the nozzle 21 with respect to the waste ink tank 17 by the cover body and the nozzle operation part 40 of the second embodiment will be described. This presupposes that the tank cover 22 is in the closing state.

For example, as shown in FIG. 33, when the pushing member 80 is rotated to the non-activation position, all of the plurality of flange gaps 83 of the pushing member 80 are respectively located so as to correspond to the plurality of ribs 73 of the cylindrical wall 70, and then, movement of the pushing member 80 to the front side is allowed. Incidentally, by fitting the plurality of ribs 73 into the plurality of flange gaps 83, rotation of the pushing member 80 is restricted.

Subsequently, the pushing member 80 and the nozzle cam 90 are moved to the front side by receiving the biasing force of the cam pushing spring 43. As the nozzle cam 90 is moved, the nozzle 21 supported by the nozzle cam 90 is moved to the front side, retracted from the inflow port 18 of the waste ink tank 17 installed in the tank installed part 23, and then, located at the retracting position at the front side. When the nozzle 21 is retracted from the waste ink tank 17, it is possible to turn off a power source of the printer 1 and to set the printer 1 to the non-activation condition.

As described above, when the nozzle cam 90 sets the nozzle 21 to the retracting state, as shown in FIG. 34, the pushing member 80 is protruded to the front side from the nozzle operating hole 31 (the cover body 30) and the operation lever 81 becomes parallel to the left and right directions to indicate the retracting state of the nozzle 21. At this time, the nozzle cam 90 is supported at the nozzle retracting state at the front side by the biasing force of the cam pushing spring 43.

In a case where the pushing member 80 and the nozzle cam 90 are in the nozzle retracting state, the lower protrusion 93 of the nozzle cam 90 is located at the front side from the locking cam 53 of the cover locking part 50. Here, if the locking cam 53 is rotated, since the rotation restricting part 63 of the locking cam 53 does not come into contact with the lower protrusion 93, the locking cam 53 can be rotated in the counterclockwise direction. That is, the locking lever 51 can be rotated in the clockwise direction and the cover locking part 50 can be set to the unlocking state.

Next, when the pushing member 80 in the nozzle retracting state is pushed to the rear side against the biasing force of the cam pushing spring 43, the nozzle cam 90 is moved to the rear side. As the nozzle cam 90 is moved, the nozzle 21 supported by the nozzle cam 90 is moved to the rear side, inserted in the inflow port 18 of the waste ink tank 17 installed in the tank installed part 23, and then, located at the projecting position at the rear side. When the nozzle 21 is inserted in the waste ink tank 17, it is possible to turn on the power source of the printer 1 and to set the printer 1 to the activation condition.

At this time, the plurality of flange gaps 83 of the pushing member 80 are moved to the rear side from the plurality of ribs 73 of the cylindrical wall 70, and then, rotation of the pushing member 80 is allowed. Here, as shown in FIG. 32, when the push member 80 is rotated to the activation position, each of the plurality of locking recessed portions 84 of the pushing member 80 is located so as to correspond to the rib 73 of the cylindrical wall 70, and then, the pushing member 80 is restricted from moving to the front side regardless of the biasing force of the cam pushing spring 43.

As described above, when the nozzle cam 90 sets the nozzle 21 to the projecting state, as shown in FIG. 24, the pushing member 80 is housed in the cylindrical wall 70 and is retracted to the rear side from the nozzle operating hole 31 (the cover body 30) and the operation lever 81 becomes parallel to the upward and downward directions to indicate the projecting state of the nozzle 21. At this time, the nozzle cam 90 is supported at the nozzle projecting state at the rear side by the pushing member 80 restricted from moving to the front side.

In a case where the pushing member 80 and the nozzle cam 90 are in the nozzle projecting state, the lower protrusion 93 of the nozzle cam 90 is located at the rear side from the locking cam 53 of the cover locking part 50. Here, the lower protrusion 93 is located at downstream side just before the rotation restricting part 63 of the locking cam 53 in the counterclockwise direction, and then, rotation of the locking cam 53 in the counterclockwise direction is restricted by contact of the rotation restricting part 63 to the lower protrusion 93. That is, the locking lever 51 is restricted from rotating in the clockwise direction and the cover locking part 50 is restricted from setting to the unlocking state.

Incidentally, in the second embodiment, the cover locking part 50 is configured similar to the first embodiment, and the locking cam 53 of the cover locking part 50 has the inner diameter slightly larger than an outer diameter of the cylindrical wall 70 and is rotatably fitted outside the cylindrical wall 70 along an outer circumference of the cylindrical wall 70. Therefore, the notch 60 and the recessed portion 62 of the locking cam 53 compose the push allowing part allowing pushing operation of the pushing member 80 of the nozzle operating part 40.

That is, when the cover locking part 50 is set to the locking state and the locking cam 53 is rotated in the clockwise direction, the notch 60 and the recessed portion are located at the same positions as the upper and lower slits 71 of the cylindrical wall 70 of the cover body 30. Subsequently, since the upper protrusion 92 and the lower protrusion 93 of the nozzle cam 90 become movable through the slits 71 and the notch 60 and the recessed portion 62 in the forward and backward directions, movement of the pushing member 80 and the nozzle cam 90 in the forward and backward directions is allowed, that is, pushing operation of the pushing member 80 is allowed.

In other words, when the cover locking part 50 is in the locking state, in a case where the pushing member 80 is in the nozzle projecting state, the cover locking part 50 cannot be set to the unlocking state, but, in a case where the pushing member 80 is in the nozzle retracting state, the cover locking part 50 can be set to the unlocking state.

When the cover locking part 50 is set to the unlocking state, the push restricting part 64 of the locking cam 53 is located at the same position as the lower protrusion 93 of the pushing member 80. At this time, since the lower protrusion 93 is located at the front side from the push restricting part 64 of the locking cam 53, movement of the pushing member 80 and the nozzle cam 90 to the rear side is restricted by contact of the lower protrusion 93 to the push restricting part 64, that is, pushing operation of the pushing member 80 is restricted. In other words, when the cover locking part 50 is in the unlocking state, the pushing member 80 cannot be switched from the nozzle retracting state to the nozzle projecting state.

Although the embodiments was described as example about a case applying the configuration of the present disclosure to the printer 1, the disclosure is not limited by this example, and the disclosure may be applied to, for example, another image forming apparatus, such as a copying machine, a facsimile or a multifunction peripheral.

While the present disclosure has been described with reference to the particular illustrative embodiments, it is not to be limited by the embodiments. It is to be appreciated that those skilled in the art can change or modify the embodiments without departing from the scope and spirit of the present disclosure.

The invention claimed is:

1. A waste ink conveying device comprising:

a waste ink tank installed in a tank installed part to contain a waste ink; and a tank cover, wherein the waste ink tank includes an inflow port in which the waste ink is flowed from a side of the tank cover, the tank cover opens/closes the tank installed part, in a case where the tank cover is an opening state, attaching/detaching of the waste ink tank to the tank installed part becomes possible and, in a case where the tank cover is a closing state, attaching/detaching of the waste ink tank to the tank installed part becomes impossible, the tank cover includes:

a nozzle being inserted in the inflow port to flow the waste ink in the waste ink tank;

a nozzle operating part switching a projecting state of the nozzle, in which the nozzle is inserted to the inflow port of the waste ink tank being installed in the tank installed part, and a retracting state of the nozzle, in which the nozzle is retracted from the inflow port of the waste ink tank being installed in the tank installed part; and a cover locking part switching a locking state, in which the tank cover cannot be shifted from the closing state to the opening state, and an unlocking state, in which the tank cover can be shifted from the closing state to the opening state, in a case where the nozzle is in the retracting state, the cover locking part becomes possible to switch from the locking state to the unlocking state, on the other hand, in a case where the nozzle is in the projecting state, the cover locking part becomes impossible to switch from the locking state to the unlocking state.

2. The waste ink conveying device according to claim 1, wherein the nozzle operating part includes a nozzle supporting part moving between one side where the nozzle is set to the retracting state and the other side where the nozzle is set to the projecting state, the cover locking part includes a locking cam rotating around the nozzle supporting part, the nozzle supporting part includes a protrusion located at one side from the locking cam in a case where the nozzle supporting part is located at one side, but located at the other side from the locking cam in a case where the nozzle supporting part is located at the other side, the locking cam is rotated in one direction in a case where the cover locking part is switched to the locking state, but rotated in the other direction in a case where the cover locking part is switched to the unlocking state, the locking cam includes a rotation restricting part protruded to the other side at a downstream side in the other direction from the protrusion.

3. The waste ink conveying device according to claim 1, wherein the nozzle becomes impossible to switch from the retracting state to the projecting state in a case where the cover locking part is in the unlocking state.

4. The waste ink conveying device according to claim 2, wherein the locking cam includes a recessed part located at the same position as the protrusion in a circumferential direction in a case where the locking cam is rotated in one direction, and a push restricting part located at the same position as the protrusion in the circumferential direction in a case where the locking cam is rotated in the other direction, the nozzle becomes impossible to switch from the retracting state to the projecting state in a case where the cover locking part is in the unlocking state.

5. The waste ink conveying device according to claim 2, wherein the cover locking part includes:

a locking member moving between a locking position where the locking member locks the tank cover to the tank installed part and an unlocking position where the locking member unlocks the tank cover to the tank installed part; and a locking lever rotating in the other direction to move the locking member to the locking position, but rotating in one direction to move the locking member to the unlocking position, the locking lever has a flange meshing with an outer circumference face of the locking cam, and is rotated in the other direction to rotate the locking cam in one direction, but is rotated in one direction to rotate the locking cam in the other direction.

6. A waste ink conveying device comprising:

a waste ink tank installed in a tank installed part to contain a waste ink; and a tank cover, wherein the waste ink tank includes an inflow port in which the waste ink is flowed from a side of the tank cover, the tank cover opens/closes the tank installed part, in a case where the tank cover is an opening state, attaching/detaching of the waste ink tank to the tank installed part becomes possible and, in a case where the tank cover is a closing state, attaching/detaching of the waste ink tank to the tank installed part becomes impossible, the tank cover includes:

a nozzle being inserted in the inflow port to flow the waste ink in the waste ink tank;

a nozzle operating part switching a projecting state of the nozzle, in which the nozzle is inserted to the inflow port of the waste ink tank being installed in the tank installed part, and a retracting state of the nozzle, in which the nozzle is retracted from the inflow port of the waste ink tank being installed in the tank installed part; and a cover locking part switching a locking state, in which the tank cover cannot be shifted from the closing state to the opening state, and an unlocking state, in which the tank cover can be shifted from the closing state to the opening state, in a case where the cover locking part is in the unlocking state, the nozzle becomes impossible to switch from the retracting state to the projecting state.

7. The waste ink conveying device according to claim 6, wherein the nozzle operating part includes a nozzle supporting part moving between one side where the nozzle is set to the retracting state and the other side where the nozzle is set to the projecting state, the cover locking part includes a locking cam rotating around the nozzle supporting part, the nozzle supporting part includes a protrusion located at one side from the locking cam in a case where the nozzle supporting part is located at one side, but located at the other side from the locking cam in a case where the nozzle supporting part is located at the other side, the locking cam is rotated in one direction in a case where the cover locking part is switched to the locking state, but rotated in the other direction in a case where the cover locking part is switched to the unlocking state, the locking cam includes a recessed part located at the same position as the protrusion in a circumferential direction in a case where the locking cam is rotated in one direction, and a push restricting part located at the same position as the protrusion in the circumferential direction in a case where the locking cam is rotated in the other direction.

8. A waste ink conveying device comprising:

a waste ink tank installed in a tank installed part to contain a waste ink; and a tank cover opening/closing the tank installed part, wherein the waste ink tank includes an inflow port in which the waste ink is flowed from a side of the tank cover, the tank cover includes:

a nozzle being inserted in the inflow port to flow the waste ink in the waste ink tank;

a nozzle operating part switching projecting and retracting of the nozzle in order to insert and retract the nozzle with respect to the inflow port; and a cover locking part switching locking and unlocking of a closing state of the tank cover, in a case where the cover locking part is in a unlocking state and the nozzle is in a retracting state, the nozzle is made incapable of switching to a projecting state, the nozzle operating part includes a nozzle supporting part moving between one side where the nozzle is set to the retracting state and the other side where the nozzle is set to the projecting state, the cover locking part includes a locking cam rotating around the nozzle supporting part, the nozzle supporting part includes a protrusion located at one side from the locking cam in a case where the nozzle supporting part is located at one side, but located at the other side from the locking cam in a case where the nozzle supporting part is located at the other side, the locking cam is rotated in one direction in a case where the cover locking part is switched to the locking state, but rotated in the other direction in a case where the cover locking part is switched to the unlocking state, the locking cam includes a recessed part located at the same position as the protrusion in a circumferential direction in a case where the locking cam is rotated in one direction, and a push restricting part located at the same position as the protrusion in the circumferential direction in a case where the locking cam is rotated in the other direction, the tank cover includes a cylindrical wall on a cover body covering the tank installed part, the cylindrical wall is erected to the other side to have a slit extended to one side in an end at the other side of the cylindrical wall, the nozzle supporting part is fitted in the cylindrical wall in a condition that the protrusion is fitted in the slit, the recessed part is located at the same position as the slit in a case where the locking cam is rotated in one direction.

9. An image forming apparatus comprising:

the waste ink conveying device according to claim 1.

10. An image forming apparatus comprising:

the waste ink conveying device according to claim 2.

11. An image forming apparatus comprising:

the waste ink conveying device according to claim 3.

12. An image forming apparatus comprising:

the waste ink conveying device according to claim 4.

13. An image forming apparatus comprising:

the waste ink conveying device according to claim 5.

14. An image forming apparatus comprising:

the waste ink conveying device according to claim 6.

15. An image forming apparatus comprising:

the waste ink conveying device according to claim 7.

16. An image forming apparatus comprising:

the waste ink conveying device according to claim 8.

* * * * *